US007462348B2

(12) United States Patent
Gruenbacher et al.

(10) Patent No.: US 7,462,348 B2
(45) Date of Patent: Dec. 9, 2008

(54) SELF-INFLATING ARTICLE

(75) Inventors: Dana Paul Gruenbacher, Fairfield, OH (US); Edward Dewey Smith, III, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 439 days.

(21) Appl. No.: 10/644,537

(22) Filed: Aug. 20, 2003

(65) Prior Publication Data

US 2006/0171997 A1 Aug. 3, 2006

(51) Int. Cl.
*A61K 9/12* (2006.01)

(52) U.S. Cl. ..... 424/44

(58) Field of Classification Search ..... 424/43, 424/44, 443

See application file for complete search history.

(56) References Cited

U.S. PATENT DOCUMENTS

| | | | | |
|---|---|---|---|---|
| 3,223,289 | A | 12/1965 | Bouet | |
| 3,921,232 | A | 11/1975 | Whyte et al. | |
| 4,216,104 | A | 8/1980 | Gergely | |
| 4,515,703 | A | 5/1985 | Haq | |
| 4,557,853 | A | 12/1985 | Collins et al. | |
| 5,094,559 | A * | 3/1992 | Rivera et al. | 401/132 |
| 5,417,674 | A | 5/1995 | Smith et al. | |
| 5,562,642 | A | 10/1996 | Smith et al. | |
| 5,941,752 | A | 8/1999 | Liebermann et al. | |
| 5,997,520 | A | 12/1999 | Ahr et al. | |
| 6,068,820 | A * | 5/2000 | De Guzman | 422/294 |
| 6,423,045 | B1 | 7/2002 | Wise et al. | |
| 6,491,928 | B1 | 12/2002 | Smith | |
| 6,506,713 | B1 | 1/2003 | Slavtcheff et al. | |
| 6,508,602 | B1 | 1/2003 | Gruenbacher et al. | |
| 6,547,468 | B2 | 4/2003 | Gruenbacher et al. | |
| 6,588,961 | B2 | 7/2003 | Lafosse-Marin et al. | |
| 6,607,739 | B1 | 8/2003 | Wallo | |
| 2002/0039558 | A1 * | 4/2002 | Farrell et al. | 424/44 |
| 2003/0064042 | A1 * | 4/2003 | Bergquist et al. | 424/70.1 |
| 2003/0084914 | A1 | 5/2003 | Simon | |
| 2004/0234711 | A1 * | 11/2004 | Young | 428/34.1 |

FOREIGN PATENT DOCUMENTS

| | | | |
|---|---|---|---|
| EP | 1201562 | A2 | 5/2002 |
| WO | WO 00/053507 | A1 | 9/2000 |
| WO | WO 01/050998 | A2 | 7/2001 |
| WO | WO 02/102331 | A2 | 12/2002 |
| WO | WO 03/000089 | A2 | 1/2003 |
| WO | WO 03/022230 | A1 | 3/2003 |
| WO | WO 03/053671 | A1 | 7/2003 |

* cited by examiner

*Primary Examiner*—Sharon E. Kennedy
(74) *Attorney, Agent, or Firm*—John M. Howell; Bridget Murray; S. Robert Chuey

(57) ABSTRACT

The self-inflating article of the present invention contains a self-inflating personal care article contains, an inflatable bladder containing a substrate, at least one rupturable reservoir, a cleansing composition wherein said rupturable reservoir is positioned within the sack of the inflatable bladder. The self-inflating article surprisingly provides effective cleansing benefits to the skin and hair in a convenient, inexpensive, and sanitary manner.

17 Claims, 4 Drawing Sheets

SELF-INFLATING ARTICLE

FIELD OF THE INVENTION

The present inventions relates to a self-inflating article comprising an inflatable bladder, at least one rupturable reservoir; and a cleansing composition wherein the rupturable reservoir delivers its contents within the inflatable bladder. The self-inflating articles are useful for cleansing the skin, hair and any other surfaces in need of cleansing.

BACKGROUND OF THE INVENTION

Personals care articles are well known in the art. Classically the process of cleansing skin or other surfaces has employed a surfactant composition. Sometimes an implement has joined the composition. Articles such as articles or pads serve a multi-purpose including acting as delivery package for the surfactant. Articles may also assist in generating foam. They also function as an abrasive assisting in the cleansing function.

References in the art disclose the use of inflatable chambers in disposable absorbent articles. These articles are used to acquire and hold body exudates to eliminate leakage of body exudates from between the absorbent article and the wearer. The drawback is that none disclose the use of surfactant or cleansing articles that produce lather. Examples include U.S. Pat. No. 5,997,520 issued to Ahr et al. on Dec. 17, 1999, U.S. Pat. No. 6,423,045 issued to Wise et al. on Jul. 23, 2002, U.S. Pat. No. 3,881,491 and 3,921,232 issued to Whyte on May 6, 1975 and Nov. 25, 1975, respectively.

U.S. Pat. No. 4,272,393 (Gergely) describes a cleaning article formed of a porous flexible sheet, especially a cellulosic paper, impregnated with detergent and a gas-generating system. The latter is formed by separating an acidic component such as citric acid from a basic component such as sodium carbonate in two separate areas of the sheet.

U.S. Pat. No. 4,515,703 (Haq), U.S. Pat. No. 4,600,620 (Lloyd et al.) and U.S. Pat. No. 4,603,069 (Haq et al.) all describe wiping articles impregnated with surfactant. These do not contain any effervescent ingredients.

WO 97/43366 (Askew et al.) reports an effervescent system to improve dispensability of granular laundry detergent powders into wash water of automatic washing machines. Citric acid and bicarbonate combinations are employed to generate effervescence.

WO 99/48469 (Yagnik et al.) discloses powdered compositions some of which may be delivered via a tea bag. These compositions are formulated with an exothermic ingredient, a pH adjusting agent such as citric acid, optionally sodium bicarbonate for an effervescent effect and an aromatic ingredient for fragrance.

U.S. Pat. Application 2003/0064042A1 (Bergquist), discloses a pouch or envelope-like articles comprising effervescent cleansing composition capable of generating a foam upon contact with water; and a envelope formed of first and second water insoluble sheets, at least one being water permeable, the first and second sheets forming there between an area housing the cleansing composition, the second substrate comprising a non-woven sheet selected from the group consisting of meltblown, spunbond and sheet combinations.

U.S. Pat. Application 2003/0063136A1 (Bergquist), discloses a curvilinear pouch or envelope wherein the hydroentangled fibers are entangled in a direction perpendicular to a major longitudinal axis of the web, and an effervescent cleanser composition.

Common to those of the aforementioned systems is the employment of effervescent anhydrous powders within the article for generating gas and foam when immersed in water or when a capsule is broken within the article. The generation of gas by the effervescent powders creates an article where the gases produced by the effervescent composition are transmitted through the article that then comes into contact with the skin or surface being cleansed. Because of the loss of gas from the interior, effervescent gas production must continue in order to replenish the lost gases. The article tends to sting the users skin and eyes and also has a dissatisfying taste if used near the face, particularly the regions around the mouth. Additionally the presence of the effervescent gases decreases the lather productivity of the surfactant system used by these articles.

Thus, a need exists for a self-inflating personal care article having a component that is durably expandable. Additionally, a need exists for a personal care article with an impermeable layer so that the gas evolving composition does not come to the surface and contact the users skin or other keratinous surfaces while at the same time provides for a superior article that has increased thickness, rigidity and handleability with a cleansing composition that provides increased lather and improved skin appearance and feel. The article should be able to be taken in or out of the shower without affecting the gas evolving composition.

SUMMARY OF THE INVENTION

It has now been discovered that the article of the present invention which comprises a self-inflating article comprising, an inflatable bladder comprising a substrate, at least one rupturable reservoir, a cleansing composition wherein said rupturable reservoir delivers its contents within the inflatable bladder, surprisingly provides effective cleansing benefits to the skin and hair in a convenient, inexpensive, and sanitary manner.

The article comprises an inflatable bladder that comprises one or more inflatable layers. The inflatable component includes a gas evolving composition and an impervious rupturable reservoir containing an activating material. The gas evolving composition and the rupturable reservoir can be located within the liquid impermeable inflatable bladder or the gas evolving composition and the rupturable reservoir can be located within an inflatable bladder with first layer that is liquid impermeable and second layer that is liquid permeable. The rupturable reservoir is breakable by the user at the point of use of the self-inflating personal care article to combine the material located within the rupturable reservoir with the gas evolving composition. The gas evolved by the combination of the gas evolving materials inflates the inflatable bladder.

In a preferred embodiment of the present invention the gas evolving composition is located within two liquid impermeable layers, the impermeable layers prevent the gas evolving composition from being transmitted through the layers onto the surface of the article so that the materials that make up the gas evolving composition do not interfere with lather production nor do the materials of the gas evolving reaction come into contact with the users skin or other keratinous surfaces. The impermeable layers also prevent gas that is formed when the gas evolving reaction takes place from escaping the inflatable bladder.

The article can be taken in or out of the shower without adversely affecting the gas evolving system. The article of the present invention also has superior thickness after the gas evolving composition reacts, and increased rigidity. The increase in rigidity provides for an article that does not crush or crumple during use and is not scratchy or damaging to the skin or surface being cleaned with resulting improved handleability. The article of the present invention can also provide a therapeutic or aesthetic benefit without the need for a separate benefit providing product.

Also provided is a method for cleansing body surfaces involving having a user break the rupturable reservoir by applying a force to the rupturable reservoir which causes the gas evolving compositions to react causing the inflatable bladder to inflate generating foam and lather from the article and contacting skin surfaces with the generated foam/lather, particularly in the context of bathing. Further provided is a kit comprising a self-inflating personal care articles in a package designed to prevent premature rupture of the rupturable reservoir located within a sack of the inflatable bladder before use of he article that can be taken in or out of the shower.

Although the preferable embodiments of the self-inflating article of the present invention are for personal care applications, it may also be in the form of a mitt, it may also be useful in a variety of other industries including household care, dish care, automotive care, marine vehicle care, and animal care; anywhere surfaces or areas needs cleansing and/or application of a benefit agent; e.g., wax, conditioner, UV protectant, etc.

DETAILED DESCRIPTION OF THE INVENTION

Figure 1:
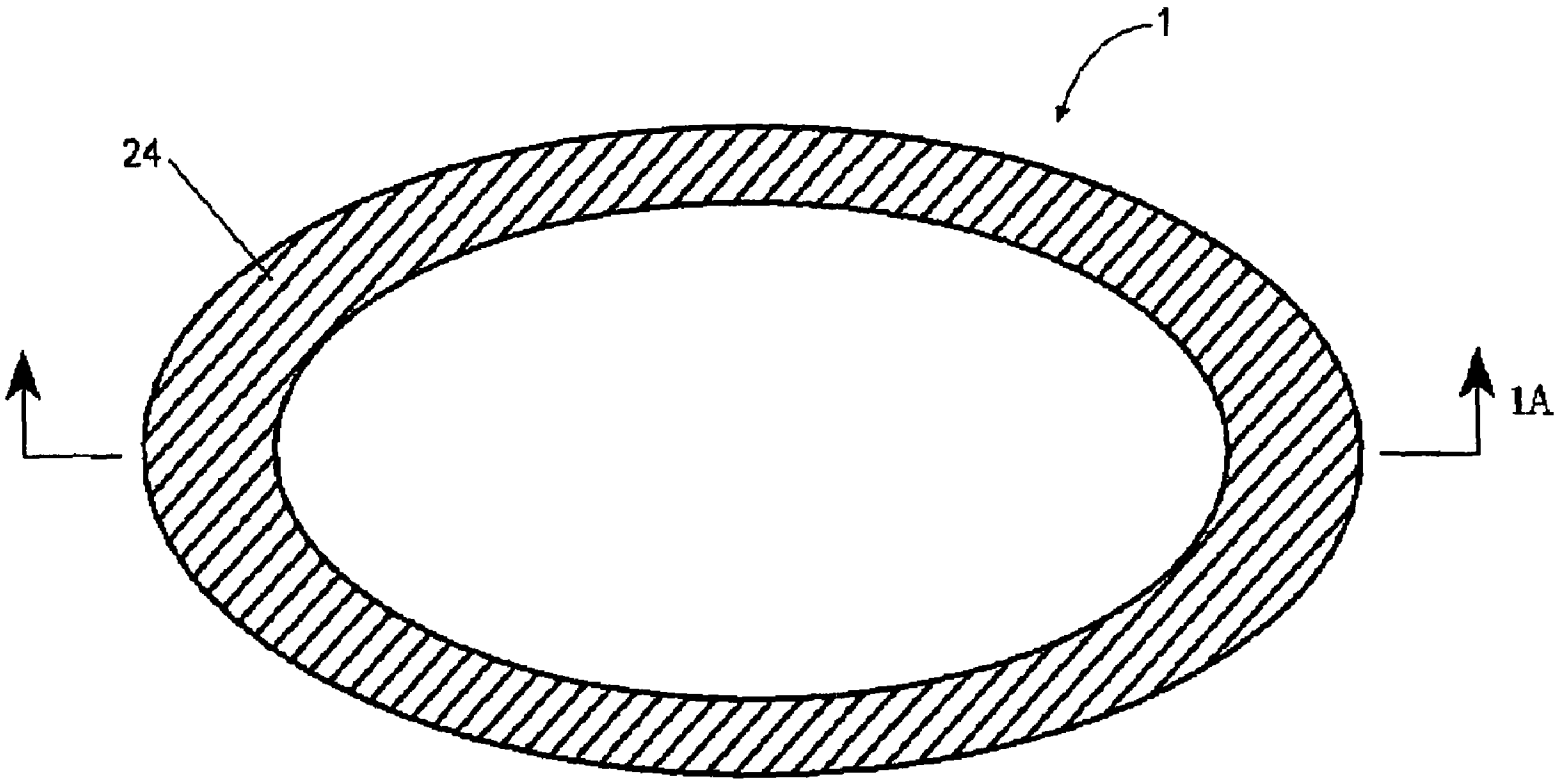
FIG. 1 illustrates one embodiment of the self-inflating article of the present invention.

By the term "chemical component" as used herein means a composition added onto, within or adjacent to the article to releasably provide or facilitate in a releasable manner a benefit, such as a lather, a moisturizing effect, a coloring effect, a dissolving effect. Surfactants, lipids, moisturizers and compositions they contain are examples of chemicals components. Webs, fibers, adhesives, resins, and films are not examples of chemical components.

By "composition associated with the "web" or "article" as used herein, means compositions that are applied to or inside of the individual fibers prior to forming the web, permeated into the web, coated onto, within or adjacent to the exposed surfaces of the web.

The term "disposable" is used herein in its ordinary sense to mean an article that is disposed or discarded after a limited number of usage events, preferably less than 5, more preferably less than about 3, and even more preferably about 1 entire usage events.

By the term "frangible" as used herein, means breakable, generally referring to a seal between two layers that can be compromised by a force or pressure to deliver a supply of a material from a location on one side of the seal to a location on the other side, especially in the context of a seal that is designated to be the first or only compromised seal if the layers are joined so that there is more than one seal.

By a "lathering surfactant" is meant a surfactant, which when combined with a fluid and mechanically agitated generates a foam or lather.

By "liquid impermeable" as used herein, means inhibits the transmission of liquid there-through for the time duration of an event, such as a use event, so that processes occurring on one side of a liquid impermeable layer are essentially unaffected by processes or by-products thereof on the other side. Articles that are liquid impermeable have a Permeability of less than 0.05 $cm^3/cm^2/sec$.

By "liquid permeable" as used herein, means allows transmission of liquid therethrough for the time duration of an event, such as a use event.

The term "moist," as used herein, means that prior to use the article can feel relatively dry to the touch and still contain high fluid content. Thus, the "moist" articles of the present invention will generally comprise from about 20% to about 40% by weight of fluid external to the reservoir.

By "reaction material" is meant a chemical compound or mixture of chemical compounds which chemically reacts or facilitates a chemical reaction with a different chemical compound, said reaction producing a gaseous product at standard temperature and pressure conditions.

By the term "rupturable reservoir" as used herein, means a material supply contained within a housing, preferably a flexible housing comprising layer(s), wherein the supply is generally a liquid or liquids, and the housing is compromisable by action of the user to liberate said supply from one location within the housing to another location, either within the housing or external to the housing.

By the term "sack" as used herein means an enclosed space which is preferably flexible having at its edge a layer or layers of any material or materials providing a barrier between the interior space and the exterior space of the sack. The sack can be a laminate, a balloon, a pillow, a sealed tube such as an extruded tube.

By "self-inflating" as used herein, means expandable by a gas without the use of an external supply of pressurized gas.

By the term "substrate" as used herein, means a generally planar sheet material, especially a material which is a fibrous nonwoven or woven material, a film, formed film or vacuum formed laminate, a laminate of more than one film such as a sealable foil laminate, an open or closed cell foam, a sponge, an adhesive sheet or a laminate of these materials, or a composite sheet material comprising the aforementioned sheet materials with other sheet materials or an adhesive, resin, or other durable or non-durable (i.e., rinsable or reactive) chemical composition or material.

The term "substantially dry," as used herein, means that prior to use generally feels dry to the touch. As used herein, "substantially dry" means that the articles of the present invention exhibit a Moisture Retention of less than about 0.95 gms, preferably less than about 0.75 gms, even more preferably, less than about 0.5 gms, even more preferably less than about 0.25 gms, even still more preferably less than about 0.15 gms, and most preferably, less than about 0.1 gms. The determination of the Moisture Retention is discussed later. Thus, the "substantially dry" articles of the present invention will generally comprise less than about 20% by weight of fluid external to the reservoir, preferably from 4% to about 20% by weight of fluid external to the reservoir, and more preferably from about 4% to about 16% by weight of fluid external to the reservoir.

The term "water-activated," as used herein, means that some of the articles of the present invention are presented to the consumer in a form to be used when wetted with a fluid. It is found that these articles produce a lather or are "activated" by either contacting them with a fluid or producing them with a fluid and then further subjecting the article to mechanical forces, such as rubbing. The term "water activating" only applies to activating the surfactant associated with the article of the present invention and not the gas evolving reaction.

By the term "web" as used herein, means a substrate that is longer in one direction than in another so that the material is advantageously processable, such as by unwinding a roll of a web in a process. An example of a web is a nonwoven or a film substrate in roll form, unwindable in a process. A web can be a laminate of more than one web, or can be a composite of a sheet material with another material including itself or a different web or substrate, and also including an adhesive, resin, or other durable or non-durable (i.e., rinsable or reactive) chemical composition or material.

The term "wet" means that prior to use the article can feel wet to the touch and contain high fluid content. The weight percent of liquid in the "wet" article is based on the total weight of the composition. The weight is expressed as a weight of the total composition. Thus, the "wet" articles of the present invention will generally comprise from about greater than 40% by weight of fluid, preferably from 40% to about 95% by weight of fluid external to the reservoir, and more preferably from about 50% to about 80% by weight of fluid external to the reservoir.

All percentages and ratios used herein are by weight of the total composition and all measurements made are at 25° C., unless otherwise designated.

Figure 2:
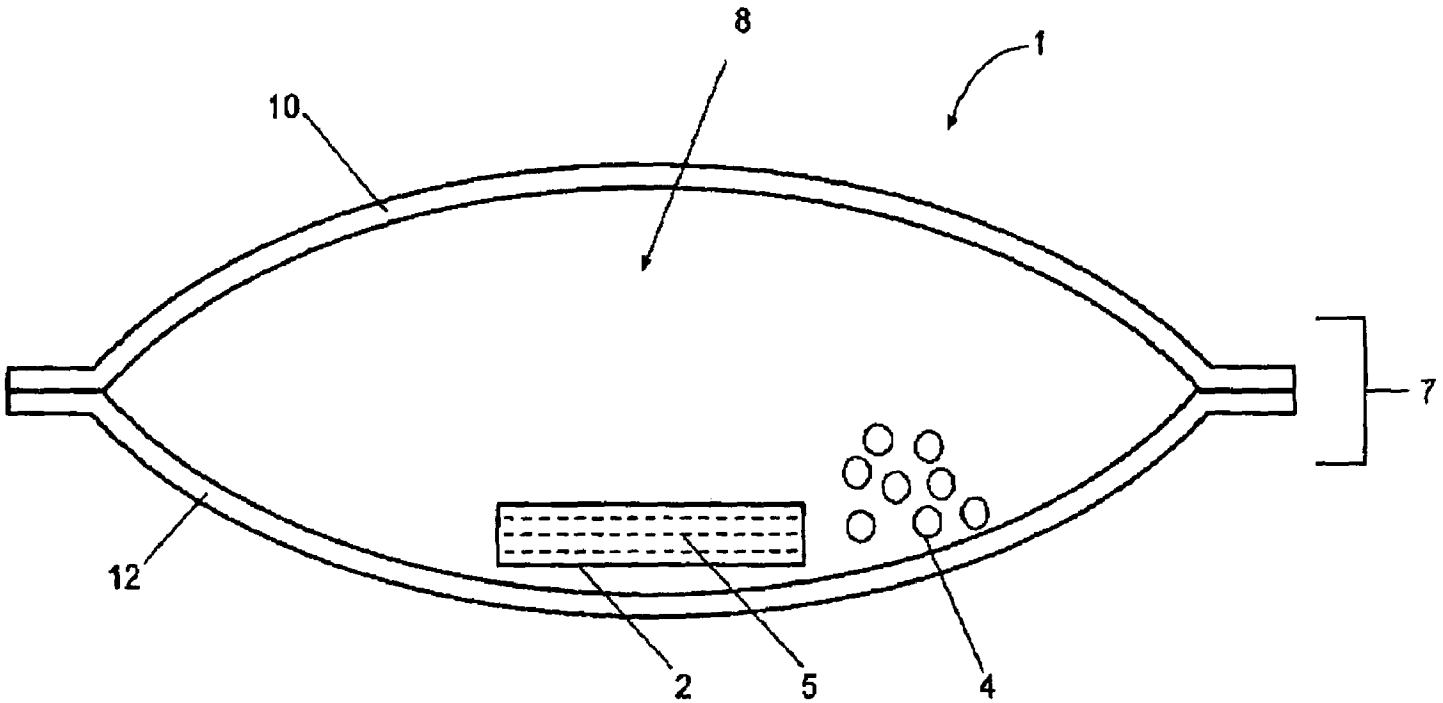
FIG. 2 illustrates a cross section embodiment of the self-inflating article of the present invention.
Figure 3:
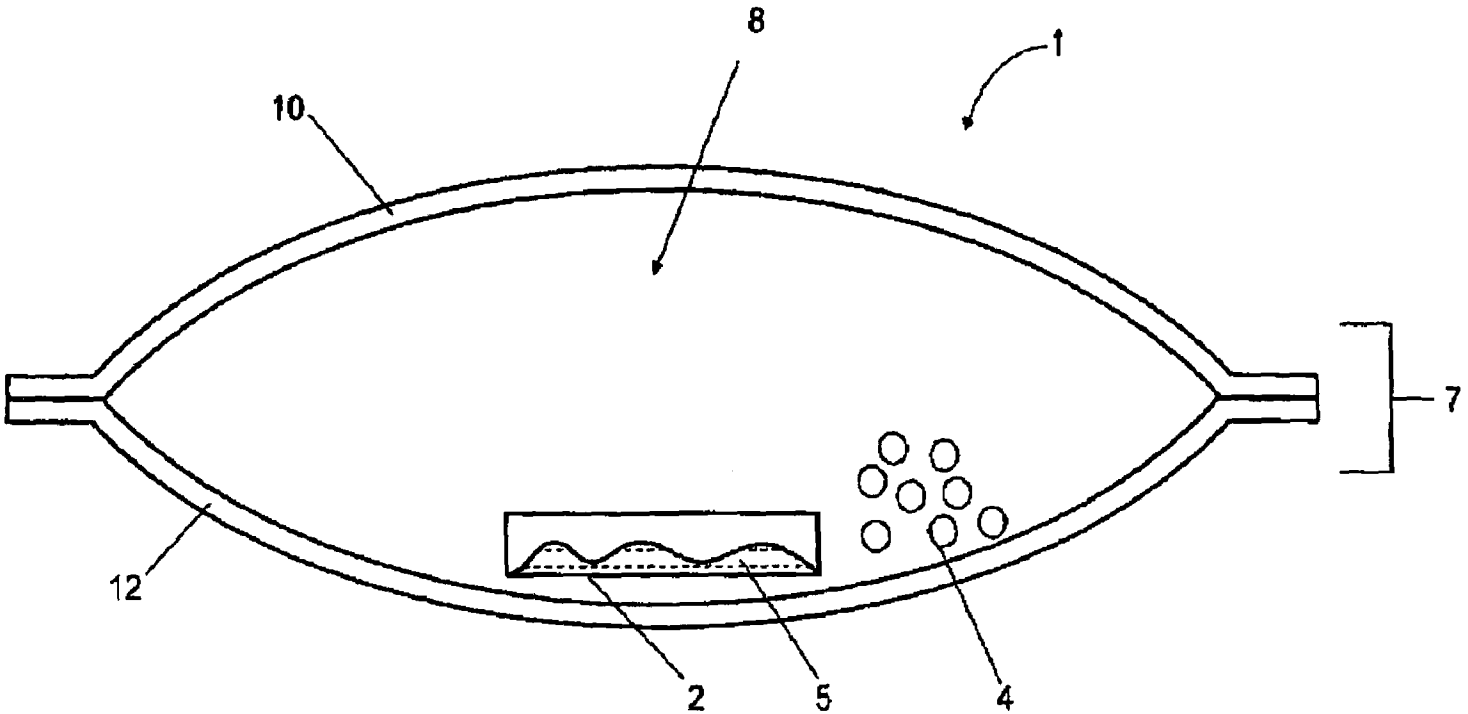
FIG. 3 illustrates another a cross section embodiment of the self-inflating article of the present invention.
Figure 4:
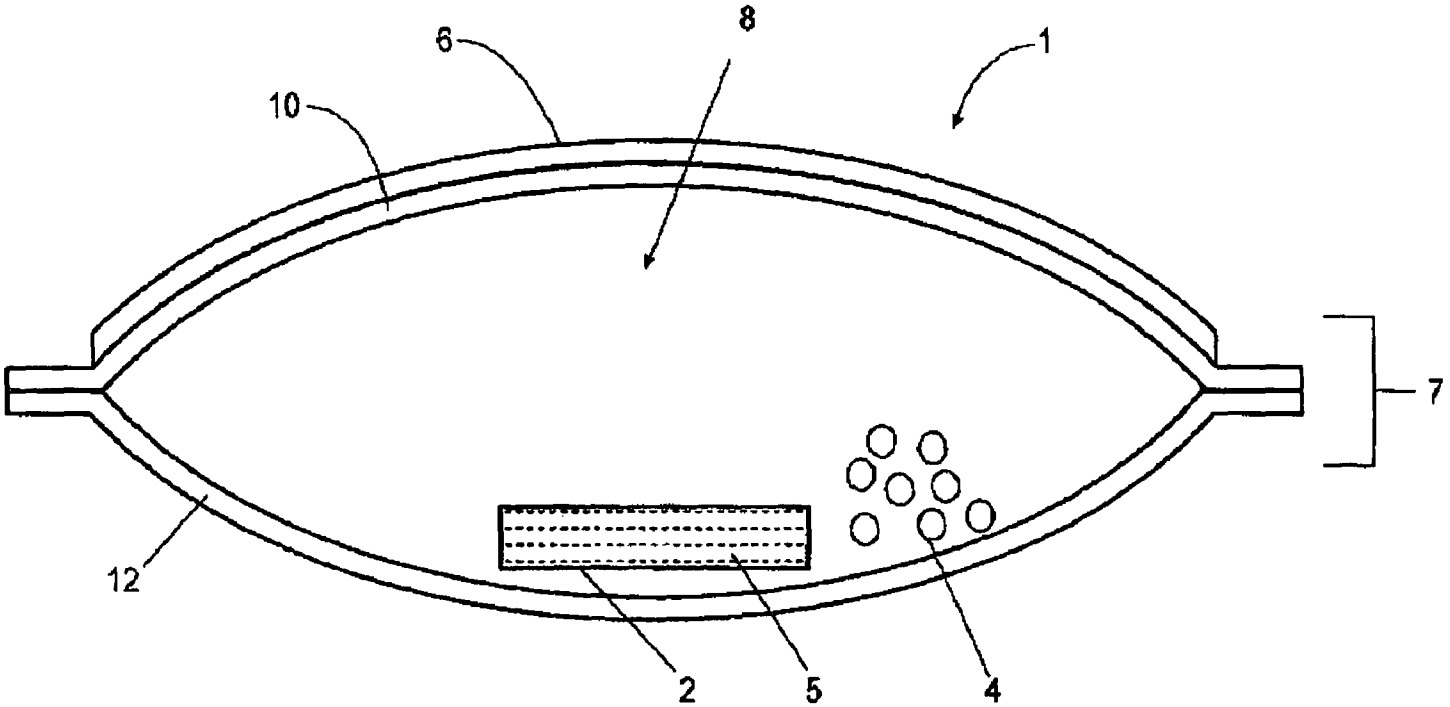
FIG. 4 illustrates another a cross section embodiment of the self-inflating article of the present invention.

FIG. 1, FIG. 2, FIG. 3, and FIG. 4 illustrate embodiments of the self-inflating article of the present invention. FIG. 1 shows the self-inflating article 1 of the present invention with a bonding site 24. FIG. 2, FIG. 3 and FIG. 4 show a cross-section of the self-inflating article which comprises inflatable bladder 7, which can comprise a substrate comprising a first layer 10 and a second layer 12. The present invention comprises at least one rupturable reservoir 2 which may contain a gas evovling composition 4 that can be either wet or dry and is preferably located within a sack 8 of the inflatable bladder 7.

The rupturable reservoir 2 may also comprise a gas evolving composition 5 interior to the rupturable reservoir 2. In the FIG. 2, the rupturable reservoir 2 illustrates that the rupturable reservoir 2 can be an entity unto itself formed by peripherally joining two flexible walls along seams and can be free to the interior of the inflatable bladder 1. The rupturable reservoir 2 can be adhered to one of the layers that form the sack 8 of the inflatable bladder 7. In an additional embodiment of the present invention shown in FIG. 3, one of the walls of the rupturable reservoir 2 can exist as the first or second layer of the inflatable bladder 1. FIG. 4, depicts a personal care composition 6.

The compositions of the present invention can comprise, consist essentially of, or consist of, the essential as well as optional ingredients and components described herein. As used herein, "consisting essentially of" means that the composition or component may include additional ingredients, but only if the additional ingredients do not materially alter the basic and novel characteristics of the claimed compositions or methods.

Inflatable Bladder

The inflatable bladder is comprised of substrates comprising a web that comprises a first layer (layer one) and a second layer (layer two) wherein the layers are preferably liquid impermeable and are preferably made from a material which is soft and flexible. In another embodiment layer one is liquid impermeable and layer two is liquid permeable. This embodiment is easier to dispose of after use. The first layer and the second layer are bonded together to form at least one sack. The first layer and the second layer can be joined by any suitable joining method such as heat/pressure sealing, adhesive bonding, ultrasonic bonding, or the like. The rupturable reservoir can be located within the sack of the inflatable bladder. The rupturable reservoir delivers its contents within the inflatable bladder.

When substrates or layers have a Permeability of less than 0.05 $cm^3/cm^2/sec$, they are considered to be impermeable to liquid water. Articles of the present invention which are more preferred have an inflatable bladder comprising substrates comprising a first layer and a second layer which have a Permeability of 0. Additionally, self-inflating articles may comprise an inflatable bladder which comprises a substrate having a first layer that is impermeable or even has a Permeability of 0, combined with a second layer which has a Permeability of less than about 15 $cm^3/cm^2/sec$, preferably less than about 8 $cm^3/cm^2/sec$, more preferably less than about 6 $cm^3/cm^2/sec$, even more preferably less than about 4 $cm^3/cm^2/sec$, and still more preferably less than about 2 $cm^3/cm^2/sec$. Other useful self-inflatable articles of the present invention may comprise substrates wherein all layers of the inflatable bladder have a Permeability of less than about 15 $cm^3/cm^2/sec$, preferably less than about 8 $cm^3/cm^2/sec$, more preferably less than about 6 $cm^3/cm^2/sec$, and even more preferably less than about 4 $cm^3/cm^2/sec$, and most preferably less than about 2 $cm^3/cm^2/sec$.

When substrates comprising the first layer and the second layer of the inflatable bladder have a Permeability greater than 0, it may be desirable to add a small amount of a component such as a fragrance or a surfactant into the internal portion of the bladder, preferably into the rupturable reservoir, in order to provide stability of the material, to increase bouquet (i.e., release of fragrance), and/or to enhance retention of gas that evolves (in the case of surfactant).

The inflatable bladder preferably has an Expansion Ratio of greater than about 150%, more preferably greater than 200%, even more preferably greater than 250%, still even more preferably greater than 300%, and most preferably greater than 375% Articles of the present invention have a High Pressure Thickness of greater than 3.0 mm, preferably greater than 5 mm, more preferably greater than 5.5 mm, even more preferably greater than about 6 mm, still more preferably greater than about 6.5 mm, still even more preferably greater than about 7 mm, and most preferably greater than about 10 mm.

The first and second layers of the inflatable bladder provide superior thickness, rigidity and softness to the articles of the present invention. The increase in thickness due to the inflation of the inflatable bladder and rigidity enhances lathering, which in turn increases cleansing and exfoliation. Additionally, the inflatable bladder layers prevent the article from being crushed or crumpled during use but still provides for a soft flexible article. Articles of the present invention preferably have a Three Point Bending Rigidity after inflation of greater than about 0.75 gm/cm/cm, more preferably greater than about 1 gm/cm/cm, still more preferably greater than about 1.5 gm/cm/cm, even more preferably greater than about 2 gm/cm/cm, still even more preferably greater than about 2.5 gm/cm/cm, most preferably greater than about 3.5 gm/cm/cm as defined by the Three Point Bending Method described below.

Articles of the present invention preferably have a Peak Force measured by the Three Point Bending test after inflation of greater than about 2.5 gm/cm, more preferably greater than about 3 gm/cm, still more preferably greater than about 3.5 gm/cm, even more preferably greater than about 4 gm/cm, most preferably greater than about 5 gm/cm The inflatable bladder layer when it is a separate layer will have a Low Pressure Thickness from about 0.01 mm to about 100 mm, preferably from about 0.05 mm to about 50 mm, more preferably from about 0.1 mm to about 10 mm, even more preferably from 0.25 mm to about 5 mm, still more preferably from about 0.4 mm to about 4 mm.

The surfaces of the inflatable bladder layers can have the same or differing textures on the top and bottom surfaces of the layers. Nonlimiting examples of differing textures can include protrusions, projections, partially heating areas of the surface of the foam to form nodules, nodes, bumps, ridges, creped structures, and fibers having different denier or compositions on one or both surfaces of the inflatable bladder layers. The article of the present invention can comprise a plurality of additional layers. In a preferred embodiment the article has a third layer comprising a web that comprises a cleansing composition associated with at least one surface of the third layer. The third layer is in communication with and juxtaposed to the second layer.

In an additional preferred embodiment, the article has a fourth layer comprising a web in communication with and juxtaposed to the first layer. The fourth layer comprises high loft material. As used herein, "loft" means that the layer has density of from about 0.00005 g/cm3 to about 0.1 g/cm3, preferably from about 0.001 g/cm3 to about 0.09 g/cm3 and a thickness of from about 0.1 mm to about 30 mm. Additionally, the high loft material of the fourth layer comprises a cleansing composition associated with the fourth layer.

This web of the inflatable bladder and the additional layers can be entirely made up of nonwovens, formed films, films, composite material, wovens and combinations and, or combination of nonwovens, formed films, films, composite material, wovens and combinations making up the web if desirable Without being limited by theory, the layers can enhance cleansing. The layers can have the same or differing textures on each side. The layers may act as an efficient lathering and exfoliating implement. By physically coming into contact with the skin or hair, the layers significantly aid in cleansing and removal of dirt, makeup, dead skin, and other debris. In preferred personal care embodiments, however, the layers are non-scouring or nonabrasive to the skin.

Advantageously at least one of the layers should be sufficiently translucent to allow viewing from outside of the ingredients. Articles may have any geometric shape including square, round, oval and tetrahedral configurations.

The layers of the inflatable article and additional layers may comprise a variety of both natural and synthetic fibers or materials. As used herein, "natural fibers" are those derived from plants, animals, insects or byproducts of plants, animals, and insects. The conventional base starting material is usually a fibrous web comprising any of the common synthetic or natural textile-length fibers, or combinations thereof.

Nonlimiting examples of natural materials useful in the present invention include, but are not limited to, silk fibers, keratin fibers and cellulosic fibers. Nonlimiting examples of keratin fibers include those selected from the group consisting of wool fibers, camel hair fibers, and the like. Nonlimiting examples of cellulosic fibers include those selected from the group consisting of wood pulp fibers, cotton fibers, hemp fibers, jute fibers, flax fibers, Tencile® and combinations thereof. Cellulosic fiber materials are preferred in the present invention. Nonlimiting examples of synthetic materials useful in the present invention include those selected from the group consisting of acetate fibers, acrylic fibers, cellulose ester fibers, modacrylic fibers, polyamide fibers, polyester fibers, polyolefin fibers, polyvinyl alcohol fibers, rayon fibers, formed films, films, and combinations thereof. Examples of suitable synthetic materials include acrylics such as acrilan, creslan, and the acrylonitrile-based fiber, orlon; cellulose ester fibers such as cellulose acetate, arnel, and acele; polyamides such as nylons (e.g., nylon 6, nylon 66, nylon 610, and the like); polyesters such as fortrel, kodel, and the polyethylene terephthalate fiber, polybutylene terephthalate fiber, dacron; polyolefins such as polypropylene, polyethylene; polyvinyl acetate fibers; polyurethane foams and combinations thereof. These and other suitable fibers and the nonwovens prepared there from are generally described in Riedel, "Nonwoven Bonding Methods and Materials," *Nonwoven World* (1987); *The Encyclopedia Americana*, vol. 11, pp. 147-153, and vol. 26, pp. 566-581 (1984); U.S. Pat. No. 4,891,227, to Thaman et al., issued Jan. 2, 1990; and U.S. Pat. No. 4,891,228,. As used herein, "nonwoven" means that the layer comprises fibers which are not woven into a fabric but rather are formed into a sheet, mat, or pad layer. The fibers can either be random (i.e., randomly aligned) or they can be carded (i.e., combed to be oriented in primarily one direction). Nonwoven substrates made from synthetic materials useful in the present invention can be obtained from a wide variety of commercial sources.

More preferred synthetic fibers for the layer are solid staple polyester fibers, which comprise polyethylene terephthalate homopolymers. Suitable synthetic materials may include solid single component and multicomponent synthetic fibers, i.e., more than one type of material making up the fibers. The synthetic fibers may comprise bicomponent or dual component fibers. Such bicomponent fibers may have a core and a sheath configuration or a side-by-side configuration. In either instance, the sheet layer may comprise either a combination of fibers comprising the above-listed materials or fibers which themselves comprise a combination of the above-listed materials.

In any instance, side-by side configuration or core-sheath configuration, the fibers of the layer may exhibit a helical or spiral configuration, particularly the bicomponent type fibers.

A preferred synthetic material for a scouring layer may comprise nylon fibers. A more preferred synthetic material comprises nylon fibers formed into a scrim layer having additional nylon fibers bonded thereto such that the additional fibers form arcs on the scrim layer.

Natural material nonwovens useful in the present invention may be obtained from a wide variety of commercial sources. Nonlimiting examples of suitable commercially available paper layers useful herein include Airtex®, an embossed airlaid cellulosic layer having a base weight of about 71 gsy, available from James River, Green Bay, Wis.; and Walkisoft®, an embossed airlaid cellulosic having a base weight of about 75 gsy, available from Walkisoft U.S.A., Mount Holly, N.C.

Additional suitable nonwoven materials include, but are not limited to, those disclosed in U.S. Pat. No. 4,447,294, issued to Osborn on May 8, 1984; U.S. Pat. No. 4,603,176 issued to Bjorkquist on Jul. 29, 1986; U.S. Pat. No. 4,981,557 issued to Bjorkquist on Jan. 1, 1991; U.S. Pat. No. 5,085,736 issued to Bjorkquist on Feb. 4, 1992; U.S. Pat. No. 5,138,002 issued to Bjorkquist on Aug. 8, 1992; U.S. Pat. No. 5,262,007 issued to Phan et al. on Nov. 16, 1993; U.S. Pat. No. 5,264,082, issued to Phan et al. on Nov. 23, 1993; U.S. Pat. No. 4,637,859 issued to Trokhan on Jan. 20, 1987; U.S. Pat. No. 4,529,480, issued to Trokhan on Jul. 16, 1985; U.S. Pat. No. 4,687,153 issued to McNeil on Aug. 18, 1987; U.S. Pat. No. 5,223,096, issued to Phan et al. on Jun. 29, 1993 and U.S. Pat. No. 5,679,222, issued to Rasch et al. on Oct. 21, 1997.

Additional formed films include microapertured 100 mesh film supplied by Tredegar, Inc., Terre Haute, Ind., USA 47808. Apertures can be formed in a film by any means such as by drawing a vacuum across the film; by forcing fluid such as water through the film while the film is supported in a fine screen such as a 100 mesh screen; by mechanical means such as punching, tearing, stretching; using energy such as heat or light. As used herein, "apertured" means that the layer includes well-defined openings. Well-defined openings are typically surrounded by well-defined land areas. Also, as used herein, "apertures" encompasses holes, perforations, cavities, and the like. The well-defined opening can be impermeable (as in a film, which would be a formed film or a perforated film, e.g.), or permeable. As used herein, "microapertured" generally refers to layers containing well-defined microscopic apertures (i.e., those not readily visible to the naked eye having 20/20 vision).

Preferred materials for the inflatable bladder web first and second layer include but are not limited to natural and synthetic polymer films, especially thermoplastic polymer and copolymer films comprising synthetic polymers and laminates, water soluble films such as polyvinylalcohol, composites or mixtures of these films with other films, wovens and nonwoven and fibrous materials thermoplastic film/metal foil laminates, natural rubbers, and laminated films of natural rubber and synthetic thermoplastics, composite films, webs or layers, polyolefin films and polyethylene films having a thickness between 0.000635 and 0.0127 centimeters (0.25 to 5.0 mils). An example of a preferred material includes a polyethylene film available from Tredegar Industries of Terre Haute, Ind. and designated C-8323 and having a thickness of about 0.028 mm (1.1 mil). Such a material has machine direction tensile strength at rupture of between 790 to 1600 grams/centimeter (2000 to 4000 grams/inch), a machine direction tensile elongation at rupture of between about 400 to 700 percent, a cross machine direction tensile strength at rupture of between 390 and 1200 grams/centimeter (1000 and 3000 grams/inch), and a cross machine direction elongation at rupture of between 400 and 800 percent. The tensile strengths and elongations listed above are measured using a constant rate of elongation tensile testing machine, such as an Instron Model 1122 made by the Instron Corp. of Canton, Ohio, operated at an elongation rate of 0.85 cm/sec (20 in/min) with a 2.54 cm (1 inch) sample width and a 5.08 cm (2 inch) gauge length.

Preferably the first layer and second layer of the inflatable bladder of the present invention can be polyolefins especially polyethylene. Additional suitable material includes closed cells foams, especially polyolefin foams such as polyethylene and polypropylene foams, for example Volara foam available from Voltek, Inc. and Microfoam available from PActiv, Inc.

Additional preferred suitable materials for the web of the inflatable bladder include but are not limited to, formed films and composite materials, i.e., multi-ply materials. Preferred formed films comprise plastics which tend to be soft to the skin. Suitable soft plastic formed films include, but are not limited to, polyolefins such as low density polyethylenes (LDPE). A preferred composite is a Vacuum Formed Laminates (VFL's), which is a composites of fibrous nonwovens and formed films. Useful webs can comprise composites for example webs treated with or formed from solid or semi-solid materials such as adhesives, surfactants, fibers, or polymeric compounds which may render the web suitable for retention of gas as described by the or impart varying degrees of permeability or make the web impermeable for the purposes of the present invention. Other suitable webs, composite webs, laminates or layers may be treated by mechanical energy, thermal energy or other treatment means which may render the web suitable for retention of gas as described by the or impart varying degrees of permeability or make the web impermeable for the purposes of the present invention.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The resulting layer, regardless of its method of production or composition, is then subjected to at least one of several types of bonding operations to anchor the individual fibers together to form a self-sustaining web. In the present invention the nonwoven layer can be prepared by a variety of processes including, but not limited to, meltblowing, spunbonding, air-entanglement, hydroentanglement, thermal bonding, and combinations of these processes.

Rupturable Reservoir

The present invention comprises at least one rupturable reservoir containing a reaction material that can be either wet or dry and is preferably located within a sack of the inflatable bladder. The user can break the rupturable reservoir by applying a force to the rupturable reservoir at any desired time at the point of use of the self-inflating article. The rupturable reservoir can be adhered to one of the layers that form the sack of the inflatable bladder.

The reaction material that is contained within the rupturable reservoir is selected from the group consisting of water, salts of carbonates and bicarbonates, such as sodium, potassium, ammonium carbonates and bicarbonates, percarbonate salts, salts of higher carbonates such as sesquicarbonates such as sodium sesquicarbonate, alkaline peroxides, alkaline azides, $C_2$ to $C_{20}$ organic mono- and poly-carboxylic acids, $C_2$ to $C_{20}$ organophosphorous acids, $C_2$ to $C_{20}$ organosulfur, toluene sulfonic acid, peroxides, lactones, natural and synthetic oligomeric and polymeric acids which are preferably water soluble such as alginates, chitosan and mixtures thereof. Optionally, the salts of carbonates and bicarbonates can be anhydrous. Preferably, the material is water, a solution of water and citric acid or sodium bicarbonate, or a suspension of an organic acid or sodium bicarbonate in a fluid. Optional materials for use inside the reservoir include water miscible liquids such as mono- and polyhydric alcohols, esters, ethers, ketones, aldehydes; materials for suspending or emulsifying the reaction materials such as surfactants, emulsifiers, polymers or fluids; materials for fixing the reaction materials in a location within or adjacent to the rupturable reservoir such as adhesives, gums or waxes.

In a preferred embodiment the rupturable reservoir contains enough water to dissolve the quantity of the gas evolving composition located within the inflatable bladder. The amount of water required will depend upon the solubility and quantity of the components of the gas evolving composition. In general, the rupturable reservoir contains at least about one milliliters of water per gram of gas evolving composition.

In another preferred embodiment the rupturable reservoir contains a citric acid solution and dry sodium bicarbonate in two different, separated locations within the reservoir. A frangible seal located between the separate locations is ruptured to release the citric acid solution directly into contact with the sodium bicarbonate to rapidly evolve gas which is subsequently released to or within the interior of the inflatable bladder, In another preferred embodiment the rupturable reservoir contains aqueous sodium bicarbonate and dry citric acid in distinct locations within the reservoir. In another preferred embodiment there are at least two rupturable reservoirs, one contains a citrate solution and the second contains bicarbonate solution. The two rupturable reservoirs can be in a side by side or other configuration, and can have a frangible seal therebetween so that rupturing the frangible seal commences the gas evolving reaction, the gas and/or contents are then deliverable to the interior of the sack, optionally as a result of the gas pressure which pops the reservoir, filling the sack. In another preferred embodiment there are at least two rupturable reservoirs one located within the other where one contains citric acid and the second contains sodium bicarbonate, either or one dissolved in water.

The rupturable reservoir can be formed by peripherally joining two flexible walls along seams. The two walls can be formed from a liquid impervious plastic film, such as a polyethylene, polypropylene, or polyester film, a liquid impervious laminate comprising high barrier packaging material such as a metallized film or a foil laminate, a liquid impervious laminate comprising polymer mixtures, layers, or copolymers having a frangible seal. A preferred wall material for the rupturable reservoir is a metallized foil laminate film manufactured by Pechiney Plastic Packaging, Chicago, Ill., USA comprising polyethylene and butylenes sealing layer or layers which produces a seal rupturable at low pressure by sealing at a temperature of about 105° C. and a harder seal when sealed at a temperature of about 145° C. The rupturable reservoir can also comprise more rigid wall materials such as waxes or thicker plastic layers, rupturable by breaking the walls of the rigid materials to expose the interior contents. The rupturable reservoir can also comprise wall materials having differing degrees of elasticity so that a strain such as produced by twisting or tearing can expose the reaction material within the reservoir. In an additional embodiment of the present invention, one of the walls of the rupturable reservoir can exist as the first or second layer of the inflatable bladder.

The two walls of the rupturable reservoir can be generally rectangular, and can be peripherally joined along 3 sides to form a pocket. Alternatively a film can be folded and joined along 2 sides to form the pocket or two different films can be sealed on 3 sides to form the pocket. The pocket can be partially filled with a liquid or any other type of material dry or wet wherein the wet material can be aqueous or non-aqueous. Preferably the wet material is aqueous and is a solvent for one or both of the gas evolving reaction materials. The fourth side of the walls can then be sealed along a seam to close the pocket and contain a liquid or any other type of material. The two walls can be joined at seams by any suitable method such as by heat/pressure sealing, adhesive bonding, ultrasonic bonding, or the like. Suitable seams can be formed using the Vertrod Model 15MGC heat sealer or any vertical or horizontal form/fill/seal machines such as provided by Volpak manufactured in Barcelona, Spain, or Winpak manufactured in San Bernadino, Calif. . . . The rupturable reservoir can comprise a number of shapes including, but not limited to, closed figures, ovals, squares, circles, straight segments, and curvilinear segments.

The rupturable reservoir preferably has a thickness of between about 0.5 mm and 50 mm, preferably between about 1.5 mm and about 20 mm, more preferably between about 1.5 mm and about 10 mm.

In one embodiment, the reservoir can be designed to burst or rupture to release the product contained within the reservoir at a comparatively low force when desired by the consumer. This may be accomplished by having a sealed reservoir with permanent seals and also seals that are "frangible", i.e., rupturable. When the reservoir is squeezed, the frangible seal will yield or fail first since it has a lower peel force to break the seal apart than the permanent seals. In one embodiment, the frangible seal will ideally rupture with about 0.5-10 lbs, more preferably from about 1-7 lbs and most preferably about 1-4 lbs of force when applied by the consumer. Adding stress concentrators in the seal geometry that will localize forces at a particular location can optimize the location of rupture. These stress concentrators can be shaped like a V, a notch, a half circle or a variety of other shapes depending upon the desired burst level. These stress concentrators will help control the force required to burst the reservoir as well as the location of where the seal will rupture. Such stress concentrators thereby focus or concentrate external pressure or mechanical forces imposed on the reservoir and its contents. For example, pressurizing a reservoir having a V-notch seal will localize forces first at the apex of the V, causing that region to rupture first. Such an arrangement can help reduce potential variability in rupture or dispensing forces and the location where the rupture occurs. Additionally, other seal angles and geometries of the seal can also be used to tailor dispensing forces for particular applications.

The rupturable reservoir may optionally have multiple chambers separating components with a frangible seal. This allows for mixing incompatible products or mixing two different materials such as a citric acid and sodium bi-carbonate solution. The solutions are separated within the reservoir until the user is ready to use. Squeezing the reservoir causes the frangible seal to rupture mixing the two fluids. An additional frangible seal can be further used to allow the mixed fluids to be dispensed into the bladder as gas is evolved.

In some embodiments, the reservoir is able to rupture at a relatively low force. This force can be in the range from at least about 1 lb. (4.448N) to at least about 3 lbs. (13.39N), when the consumer is ready to use the article. However, the reservoir should be capable of surviving relatively higher forces, such as in the range from at least about 10 tbs. (44.48N) to at least about 40 lbs. (177.9N) when the article is in retail distribution channels. Such higher forces can be accomplished by folding the reservoir on the frangible seal or between the frangible seal and the reservoir. In a particular embodiment, folding the reservoir has been shown to effectively raise the bursting force from at least about 30 lbs. (133.4N) to at least about 40 lbs. (177.9N).

The reservoir can be made rupturable or frangible by a number of different techniques. Preferably, a reservoir is manufactured from a flexible film or substrates provided in a roll form on a vertical or horizontal form/fill/seal machine that has the ability to make different seals on the reservoir at different temperatures, pressures, and/or seal times. This can allow one side of a reservoir to have a different sealing condition that provides one side with a weaker seal strength.

As would be known to one of skill in the art, a weaker seal strength can be accomplished in a variety of ways. This can include providing two films with different sealant resins, providing a film with the same peelable sealant typically done using a "contaminant" blended into the sealant layer, or providing localized weak areas (e.g., by printing a coating or inserting an incompatible film). A preferred embodiment uses a sealant whose peel strength when sealed to itself shows a suitable peel strength at low temperatures and a higher peel strength at high temperatures.

A suitable sealant material for a frangible seal would be Surlyn® AD8273 manufactured by DuPont® that comprises a blend of polypropylene with an ionomer. Another suitable material is a blend of polybutene-1 (PB-1) with a polyolefin or ethylene copolymer, including, but not limited to, ethylene vinyl acetate (EVA), ethylene methyl acrylate (EMA), ethylene acrylic acid (EAA), ethylene methacrylic acid (EMAA), partially neutralized acid copolymers (ionomers), high density polyethylene (HDPE), linear low density polyethylene (LLDPE), low density polyethylene (LDPE), plastomers, metallocene polyethylene (mPE), polypropylene (PP), or ultra-low density ethylene (ULDPE) copolymers.

The peel strength is strongly affected by the amount of the contaminant (minor phase). In a preferred embodiment, there is at least about 10% of the contaminant present. The blend can contain more than two components. Exemplary but non-limiting potential blends include PB-1/PP/ionomer, HDPE/ionomer/LDPE, EVA/PB/LDPE, or EAA/ionomer/PB/PP. These blends can be made using a twin screw compounder or can be done by adding various resins directly to the film extruder. The blend can provide a contaminant to the base polymer material that can allow the resulting seal to be selectively frangible under certain sealing conditions. For example, at 200° F. (93.3° C.), the sealant layer can deliver a seal force of about 200 to about 400 grams per linear inch (200-400 g/2.54 cm) of seal width and at 300° F. (140.9° C.), the sealant layer can deliver a seal force approximately 3,000 grams per linear inch (3,000 g/2.54 cm) of seal width. This variation in seal strength can allow a reservoir to be welded shut in one portion and easily burstable in a second portion by adjusting the seal temperature, the seal time, and/or the seal pressure used when making the reservoir seals (e.g., the reservoir can be welded along all or a portion of one, two, three, or more sides and easily burstable along a portion of one, two, three, or more sides). A preferable film structure for this type of frangible reservoir could be sealant/tie layer/metallized PET so that the sealant contains PB-1.

Alternative film structures could include a multi-layer co-extrusion that could be the reservoir film by itself or could be laminated to another layer, such as PET, PP, or some other film or substrate. The multi-layer co-extrusion could contain barrier resins, such as, but not limited to, EVOH, PVDC, cyclic olefin copolymers (COC), liquid crystalline polymers (LCP), or polyamides to reduce losses of the contents in the reservoir. An exemplary but non-limiting structure could provide a five-layer co-extrusion of LDPE and PB-1/tie layer/EVOH or PVDC/tie layer/HDPE. This structure can be coextruded as a blown or cast film. This high barrier film can provide adequate shelf life for the contents of reservoir and can also prevent transmission losses, evaporation losses, or absorption losses. Optionally, an adequate barrier can be provided from a film having sufficient thickness or by adding barrier coatings to one or more of the layer(s). An exemplary but non-limiting barrier layer could comprise three to six mils (0.076 mm-0.152 mm) of HDPE in combination with another layer that acts as the sealant layer to provide both the frangible and permanent seals. Another example could apply a PVDC barrier coating to a Surlyn®/tie layer/HDPE cast co-extrusion.

Other techniques for making a consumer activated rupturable reservoir can include delaminating seals or weak regions in the film structure such as created by embossing, laser scoring, mechanical scoring, or other known methods to one of skill in the art in weakening a film structure. This can also include heat seal coatings typically applied from solution or the use of two films containing dissimilar heat seal layers. Additionally, small thermoformed cells with thin regions that rupture when squeezed can be used. Still further a thin rupturable heat sealeable foil could be used as one or both sides of the rupturable reservoir such that the foil ruptures when the reservoir is pressed.

The rupturable reservoir can be weakened to break along a predetermined direction so that the liquid or other suitable material is directed toward the gas evolving composition or release one material of the gas evolving composition or release all materials of the gas evolving composition.

Gas Evolving Composition

In the present invention an inflatable bladder comprises a substrate comprising a web comprising a first layer and a second layer wherein said web is preferably liquid impermeable. The first layer and the second layer are bonded together to form at least one sack. The gas evolving composition is associated with the webs of the inflatable bladder that comprises the sack. The gas evolving composition can be unconstrained in the inflatable bladder, or adhesively adhered to one of the layers to prevent the gas evolving composition from shifting during shipping and storage, or it can be located in at least one rupturable reservoir.

The gas evolving composition that is associated with the web disclosed above includes an acidic material. Suitable for this purpose are any acids present in dry solid form. Especially appropriate are $C_2$ to $C_{20}$ organic mono- and polycarboxylic acids and especially alpha- and beta-hydroxycarboxylic acids; $C_2$ to $C_{20}$ organophosphorus acids such as phytic acid; $C_2$ to $C_{20}$ organosulfur acids such as toluene sulfonic acid; and peroxides such as hydrogen peroxide. Typical hydroxycarboxylic acids include adipic, glutaric, succinic, tartaric, malic, maleic, lactic, salicylic and citric acids as well as acid forming lactones such as gluconolactone and glucarolactone. Most preferred is citric acid. Also suitable as acid material may be encapsulated acids. Typical encapsulating material may include water-soluble synthetic or natural polymers such as polyacrylates (e.g. encapsulating polyacrylic acid), cellulosic gums, polyurethane and polyoxyalkylene polymers. By the term "acid" is meant any substance which when dissolved in deionized water at 1% concentration will have a pH of less than 7, preferably less than 6.5, optimally less than 5. These acids preferably at 25° C. are in solid form, i.e. having melting points no less than 25° C. Concentrations of the acid should range from about 0.5 to about 80%, preferably from about 10 to about 65%, more preferably from about 20 to about 45% by weight of the total article. Acid can be added to the article at a weight per web area of between about 0.5 gsm and 1,000 gsm of web area, preferably between 1 and 100 gsm, more preferably between about 2.5 gsm and 50 gsm, and most preferably between about 10 gsm and 35 gsm. Only relatively low amounts of acid are needed because of the high efficiency of creating and capturing the evolved gas interior to the article in the inflatable bladder of the present invention. Acid can be added dry, wet including dissolved, suspended or both, or added dry and dissolved after adding to the article. Acid can be added in correct stoichiometric relationship to fully react with alkaline material without excess, or be added in excess to ensure rapid and full reaction.

Another component of the gas evolving composition that is associated with the web disclosed above is that of an alkaline material. The alkaline material is a substance which can generate a gas such as carbon dioxide, nitrogen or oxygen, i.e. gas evolve, when contacted with water and the acidic material. Suitable alkaline materials are salts of carbonates and bicarbonates, alkaline peroxides (e.g. sodium perborate and sodium percarbonate) and azides (e.g. sodium azide). Optionally, the salts of carbonates and bicarbonates can be anhydrous. Preferably the alkaline material is sodium or potassium bicarbonate. Amounts of the alkaline material may range from about 1 to about 80%, preferably from about 5 to about 49%, more preferably from about 15 to about 40%, optimally from about 25 to about 35% by weight of the total article. Alkaline material can be added to the article at a weight per web area of between about 0.5 gsm and 1,000 gsm of web area, preferably between 1 and 100 gsm, more preferably between about 2.5 gsm and 50 gsm, and most preferably between about 10 gsm and 40 gsm. Preferably, the alkaline material will be about less than 75 gsm. Only these relatively low amounts of alkaline material are needed because of the high efficiency of creating and capturing the evolved gas interior to the article in the inflatable bladder of the present invention. Alkaline material can be added dry, wet including dissolved, suspended or both, or added dry and dissolved after adding to the article. Alkaline material can be added in correct stoichiometric relationship to fully react with acid material without excess, or be added in excess to ensure rapid and full reaction.

By the term "anhydrous" is meant the presence of no more than 5%, preferably no more than 3.5% and optimally no more than 1% water by weight of the total composition. Water of hydration is not considered to be water for purposes of the anhydrous definition. However, it is preferred to minimize, preferably to eliminate any water of hydration.

Advantageously the combined amount of acidic and alkaline materials will be at least about 1.5%, preferably from about 5 to about 95%, more preferably from about 10 to about 80%, optimally from about 15 to about 70% by weight of the total article.

The speed of inflation of the inflatable bladder is controlled by forming the gas evolving composition as a solution or suspension (rapid inflation) as a fine powder (moderately rapid inflation), or as a compressed tablet (slow inflation). In addition, the gas evolving composition can have a coating that dissolves in the liquid from the rupturable reservoir to provide a time delayed inflation. The amounts of the alkaline and the acid which are mixed to evolve a given volume of carbon dioxide when dissolved in a liquid can be determined by stoichiometry. Commonly assigned U.S. Pat. No. 3,881,491 issued to Whyte on May 6, 1975 is incorporated herein by reference for the purpose of showing a method for calculating the amounts of an alkaline and acid which can be mixed to provide a given volume of carbon dioxide gas when dissolved in water. An excess of gas evolved compared to the volume of the bladder can be useful to enhance rigidity or to allow for some gas escape.

The gas evolving composition can be entirely contained within the rupturable reservoir or multiple rupturable reservoirs, or can be partly contained within the rupturable reservoir and partly within the interior of the inflatable bladder. Components of the gas evolving composition can be optionally be fixed at a location by a resin, gum, adhesive, wax, or the like so that they are immobilized, for example so that the fluid contents of a reservoir are delivered to the site where the component or components are immobilized in order to facilitate their reaction.

Cleansing Compositions

The present invention comprises self-inflating articles. The articles are preferably substantially dry, but they can be substantially dry, moist or wet. Preferably these articles are personal care articles with a cleansing composition used by individuals primarily for cleansing and, or treatment of skin, hair or other and similar keratin-containing surfaces including skin, hair and finger and toe nails. Preferably, the articles of the present invention comprise one or more lathering surfactants that are associated with the article of the present invention. Thus the lathering or non-lathering surfactants can be associated with the self-inflating article. Generally this will be done prior to the point of use of the article, i.e., the surfactants will be combined with the article before the article is ultimately used.

In an embodiment of the present invention, self-inflating articles can be used by individuals for dish washing. The hard surface compositions used in dishwashing will preferably comprise a cleansing paste preferably comprising a surfactant. By 'paste' is meant herein that the material is in a solid state and does not continuously change its shape or yield when subjected to a given stress preferably of about 50 to about 160 Pa at 25° C.

In the context of this application, lathering surfactant means a surfactant, that when combined with a fluid and mechanically agitated generates foam or lather sufficient to cause the article that it's associated with to form a lather. Preferably, these lathering surfactants and, or their combination with other surfactants should be mild, which means that these surfactants provide sufficient cleansing or detersive benefits but do not overly dry the skin or hair.

A wide variety of lathering surfactants are useful for the cleansing compositions described herein and include those selected from the group consisting of anionic lathering surfactants, nonionic lather surfactants, amphoteric lathering surfactants, hard water soluble surfactants and mixtures thereof. Non-limiting examples of lathering surfactants useful in the compositions of the present invention are disclosed in U.S. Pat. No. 6,280,757, to McAtee et al., issued Aug. 28, 2001. Generally, the lathering surfactants do not strongly interfere with deposition of any conditioning agents that are present, e.g., are fairly water soluble, and usually have an HLB value of above 10. Cationic surfactants can also be used as optional components.

The cleansing compositions of the present invention comprise a sufficient amount of one or more lathering surfactants such that the compositions are capable of generating from at the least about 300 ml of Flash Lather Volume more preferably at least about 325 ml of Flash Lather Volume, even more preferably at least about 350 ml of Flash Lather Volume, still even more preferably at least about 400 ml of Flash Lather Volume, even still more preferably at least 450 ml of Flash Lather Volume, and most preferably at least about 500 ml of Flash Lather Volume according to the Lather Volume Test described below. Preferably the cleansing composition generates at the least about 750 ml of Total Lather Volume, preferably at least about 900 ml of Total Lather Volume, more preferably at least about 1000 ml of Total Lather Volume, even more preferably at least about 1250 ml of Total Lather Volume, still even more preferably at least about 1500 ml of Total Lather Volume, and most preferably at least about 1700 ml of Total Lather Volume according to the Lather Volume Test described below.

Generally the cleansing composition will preferably comprise no more than about 1600 weight percent by weight of the article of the lathering surfactant, preferably comprise no more than about 1000 weight percent, more preferably no more than about 800 weight percent, and still more preferably no more than about 600 weight percent by weight of the article of a lathering surfactant. Generally the cleansing composition will preferably comprise at least 15 weight percent by weight of the article of the lathering surfactant, preferably at least 25 weight percent, more preferably at least 50 weight percent, and still more preferably at least 60 weight percent by weight of the article of a lathering surfactant. The articles can also be free of a surfactant composition, having a separate surfactant composition add to the cloth exterior at the point of use.

Suitable surfactants for the self-inflating personal care compositions described above include the following surfactants:

Anionic Lathering Surfactants

Non-limiting examples of anionic lathering surfactants useful in the compositions of the present invention are disclosed in McCutcheon's, Detergents and Emulsifiers, North American edition (1986), published by allured Publishing Corporation; McCutcheon's, Functional Materials, North American Edition (1992); and U.S. Pat. No. 3,929,678, to Laughlin et al., issued Dec. 30, 1975.

A wide variety of anionic lathering surfactants are useful herein. Non-limiting examples of anionic lathering surfactants include those selected from the group consisting of sarcosinates, sulfates, isethionates, taurates, phosphates, lactylates, glutamates, and mixtures thereof. Amongst the isethionates, the alkoyl isethionates are preferred, and amongst the sulfates, the alkyl and alkyl ether sulfates are preferred.

Other anionic materials useful herein include are fatty acid soaps (i.e., alkali metal salts, e.g., sodium or potassium salts) typically having from a fatty acid having about 8 to about 24 carbon atoms, preferably from about 10 to about 20 carbon atoms. These fatty acids used in making the soaps can be obtained from natural sources such as, for instance, plant or animal-derived glycerides (e.g., palm oil, coconut oil, soybean oil, castor oil, tallow, lard, etc.). The fatty acids can also be synthetically prepared. Soaps and their preparation are described in detail in U.S. Pat. No. 4,557,853.

Other anionic materials include phosphates such as monoalkyl, dialkyl, and trialkylphosphate salts. Non-limiting examples of preferred anionic lathering surfactants useful herein include those selected from the group consisting of sodium lauryl sulfate, ammonium lauryl sulfate, ammonium laureth sulfate, sodium laureth sulfate, sodium trideceth sulfate, ammonium cetyl sulfate, sodium cetyl sulfate, ammonium cocoyl isethionate, sodium lauroyl isethionate, sodium lauroyl lactylate, triethanolamine lauroyl lactylate, sodium caproyl lactylate, sodium lauroyl sarcosinate, sodium myristoyl sarcosinate, sodium cocoyl sarcosinate, sodium lauroyl methyl taurate, sodium cocoyl methyl taurate, sodium lauroyl glutamate, sodium myristoyl glutamate, and sodium cocoyl glutamate and mixtures thereof.

Especially preferred for use herein is ammonium lauryl sulfate, ammonium laureth sulfate, sodium lauroyl sarcosinate, sodium cocoyl sarcosinate, sodium myristoyl sarcosinate, sodium lauroyl lactylate, and triethanolamine lauroyl lactylate.

Non-ionic Lathering Surfactants

Non-limiting examples of nonionic lathering surfactants for use in the compositions of the present invention are disclosed in McCutcheon's, Detergents and Emulsifiers, North American edition (1986), published by allured Publishing Corporation; and McCutcheon's, Functional Materials, North American Edition (1992).

Nonionic lathering surfactants useful herein include those selected from the group consisting of alkyl glucosides, alkyl polyglucosides, polyhydroxy fatty acid amides, alkoxylated fatty acid esters, lathering sucrose esters, amine oxides, and mixtures thereof Non-limiting examples of preferred nonionic surfactants for use herein are those selected form the group consisting of $C_8$-$C_{14}$ glucose amides, $C_8$-$C_{14}$ alkyl polyglucosides, sucrose cocoate, sucrose laurate, lauramine oxide, cocoamine oxide and mixtures thereof.

Amphoteric Lathering Surfactants

The term "amphoteric lathering surfactant," as used herein, is also intended to encompass zwitterionic surfactants, which are well known to formulators skilled in the art as a subset of amphoteric surfactants.

A wide variety of amphoteric lathering surfactants can be used in the compositions of the present invention. Particularly useful are those which are broadly described as derivatives of aliphatic secondary and tertiary amines, preferably wherein the nitrogen is in a cationic state, in which the aliphatic radicals can be straight or branched chain and wherein one of the radicals contains an ionizable water solubilizing group, e.g., carboxy, sulfonate, sulfate, phosphate, or phosphonate.

Non-limiting examples of amphoteric surfactants useful in the compositions of the present invention are disclosed in McCutcheon's, Detergents and Emulsifiers, North American edition (1986), published by allured Publishing Corporation; and McCutcheon's, Functional Materials, North American Edition (1992).

Non-limiting examples zwitterionic surfactants are those selected from the group consisting of betaines, sultaines, hydroxysultaines, alkyliminoacetates, imninodialkanoates, aminoalkanoates, and mixtures thereof.

Preferred lathering surfactants for use herein are the following, wherein the anionic lathering surfactant is selected from the group consisting of ammonium lauroyl sarcosinate, sodium trideceth sulfate, sodium lauroyl sarcosinate, ammonium laureth sulfate, sodium laureth sulfate, ammonium lauryl sulfate, sodium lauryl sulfate, ammonium cocoyl isethionate, sodium cocoyl isethionate, sodium lauroyl isetlionate, sodium cetyl sulfate, sodium lauroyl lactylate, triethanolamine lauroyl lactylate, and mixtures thereof, wherein the non-ionic lathering surfactant is selected from the group consisting of lauramine oxide, cocoamine oxide, decyl polyglucose, lauryl polyglucose, sucrose cocoate, $C_{12}$-$_{14}$ glucosamides, sucrose laurate, and mixtures thereof; and wherein the amphoteric lathering surfactant is selected from the group consisting of disodium lauroamphodiacetate, sodium lauroamphoacetate, cetyl dimethyl betaine, cocoamidopropyl betaine, cocoamidopropyl hydroxy sultaine, and mixtures thereof.

Mid-chain Branched Surfactants

Mid-chain branched surfactants are described in detail in U.S. Pat. No. 6,335,312. Mid-chain branched surfactants are high lathering surfactants and are hard water tolerant. Typically, mid-chain branched surfactants are hard water soluble and have the corresponding structural formula:

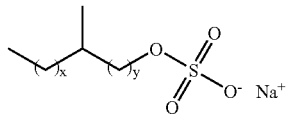

HSAS x + y = 13 or 14; y ≥ 1

An example of mid-chain branched surfactants includes ethoxylated mid-chain branched surfactants corresponding to the structural formula:

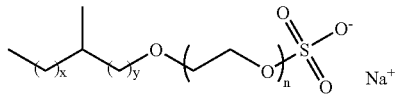

HSAE(n)S x + y = 13 or 14; y ≥ 1

Hard Water Tolerant Surfactants

Hard water tolerant surfactants are selected from the group consisting of nonionic lathering surfactants, phosphates, mid-chain branched surfactants and mixtures thereof.

Optional Ingredients

The cleansing composition of the present invention may contain one or more additional skin care components. In a preferred embodiment, where the compositions are to be in contact with human keratinous tissue, the additional components should be suitable for application to keratinous tissue, that is, when incorporated into the composition they are suitable for use in contact with human keratinous tissue without undue toxicity, incompatibility, instability, allergic response, and the like within the scope of sound medical judgment.

The *CTFA Cosmetic Ingredient Handbook*, Second Edition (1992) describes a wide variety of nonlimiting cosmetic and pharmaceutical ingredients commonly used in the personal care industry, which are suitable for use in the compositions of the present invention.

In any embodiment of the present invention, however, the additional components useful herein can be categorized by the benefit they provide or by their postulated mode of action. However, it is to be understood that the additional components useful herein can in some instances provide more than one benefit or operate via more than one mode of action. Therefore, classifications herein are made for the sake of convenience and are not intended to limit the active to that particular application or applications listed.

Benefit Agents

The articles of the present invention can comprise a benefit agent that is useful for providing a therapeutic benefit and/or cosmetic benefit to the skin, hair and similar keratin-containing surfaces during the use of the article. The benefit agents are suitable for application to keratin-containing tissue, that is, they are suitable for use in contact with human keratin-containing tissue without undue toxicity, incompatibility, instability, allergic response, and the like within the scope of sound medical judgment.

The benefit agent can comprise no more than about 1600 weight percent, preferably no more than about 1000 weight percent of a substrate, more preferably no more than about 800 weight percent, and most preferably no more than about 600 weight percent of a skin treatment agent. The benefit agent can comprise at least 0.05 weight percent of a substrate, preferably at least 15 weight percent, more preferably at least 20 weight percent, and most preferably no more than about 60 weight percent of a substrate of a benefit agent.

The benefit agents useful in the present invention can comprise compositions described herein. The optional components useful herein can be categorized by their therapeutic or aesthetic benefit or their postulated mode of action. However, it is to be understood that the optional components useful herein can in some instances provide more than one therapeutic or aesthetic benefit or operate via more than one mode of action. Therefore, classifications herein are made for the sake of convenience and are not intended to limit the component to that particular application or applications listed. Also, when applicable, the pharmaceutically-acceptable salts of the components are useful herein.

The articles of the present invention may optionally contain one or more of such optional ingredients. Examples of these ingredient classes include: enzymes, abrasives, skin exfoliating agents, absorbents, aesthetic components such as fragrances, pigments, colorings/colorants, essential oils, skin sensates, astringents, etc. (e.g., clove oil, menthol, camphor, eucalyptus oil, eugenol, menthyl lactate, witch hazel distillate), anti-acne agents (e.g., resorcinol, sulfur, salicylic acid, erythromycin, zinc, etc.), anti-caking agents, antifoaming agents, additional antimicrobial agents (e.g., iodopropyl butylcarbamate), antioxidants, binders, biological additives, buffering agents, bulking agents, chelating agents, chemical additives, colorants, cosmetic astringents, cosmetic biocides, denaturants, drug astringents, external analgesics, film formers or materials, e.g., polymers, for aiding the film-forming properties and substantivity of the composition (e.g., copolymer of eicosene and vinyl pyrrolidone), humectants, opacifying agents, pH adjusters, propellants, reducing agents, sequestrants, skin bleaching agents (or lightening agents) (e.g., hydroquinone, kojic acid, ascorbic acid, magnesium ascorbyl phosphate, ascorbyl glucosamine), skin-conditioning agents (humectants, including miscellaneous and occlusive), skin soothing and/or healing agents (e.g., panthenol and derivatives (e.g., ethyl panthenol), aloe vera, pantothenic acid and its derivatives, allantoin, bisabolol, and dipotassium glycyrrhizinate), skin treating agents, including agents for preventing, retarding, arresting, and/or reversing skin wrinkles (e.g., alpha-hydroxy acids such as lactic acid and glycolic acid and beta-hydroxy acids such as salicylic acid), thickeners, hydrocolloids, particular zeolites, and vitamins and derivatives thereof (e.g. tocopherol, tocopherol acetate, beta carotene, retinoic acid, retinol, retinoids, retinyl palmitate, niacin, niacinamide, and the like). The articles of the present invention may include carrier components such as are known in the art. Such carriers can include one or more compatible liquid or solid filler diluents or vehicles which are suitable for application to skin or hair.

The articles of the present invention may optionally contain one or more of such optional components. Preferred articles optionally contain a safe and effective amount of an therapeutic benefit component comprising a therapeutic benefit agent selected from the group consisting of vitamin compounds, conditioning agents, skin treating agents, anti-acne actives, anti-wrinkle actives, anti-skin atrophy actives, anti-inflammatory actives, topical anesthetics, artificial tanning actives and accelerators, anti-microbial actives, anti-fungal actives, sunscreen actives, anti-oxidants, skin exfoliating agents, and combinations thereof. As used herein, "a safe and effective amount" means an amount of a compound or component sufficient to significantly induce a positive effect or benefit, but low enough to avoid serious side effects, (e.g., undue toxicity or allergic reaction), i.e., to provide a reasonable benefit to risk ratio, within the scope of sound medical judgment.

Conditioning Agents

The articles of the present invention can comprise a conditioning agent that is useful for providing a conditioning benefit to the skin, hair and other parts of the body with keratin-containing tissue. The conditioning agent can comprise no more than about 1600 weight percent of a substrate, preferably no more than about 1000 weight percent, more preferably no more than about 800 weight percent, and most preferably no more than about 600 weight percent of a conditioning agent. The conditioning agent can comprise at least 0.05 weight percent of a substrate, preferably at least 15 weight percent, more preferably at least 15 weight percent, and most preferably no more than about 60 weight percent of a conditioning agent.

The conditioning agent useful in the present invention can comprise: a water soluble conditioning agent or an oil soluble conditioning agent. The water soluble conditioning agent and oil soluble conditioning agent can be combined to form a conditioning emulsion. The oil soluble conditioning agent is selected from one or more oil soluble conditioning agents such that the weighted arithmetic mean solubility parameter of the oil soluble conditioning agent is less than or equal to 10.5.

Solubility parameters are well known to the formulation chemist of ordinary skill in the art and are routinely used as a guide for determining compatibilities and solubilities of materials in the formulation process. See "Solubility Effects in Product, Package, Penetration, and Preservation", Cosmetics and Toiletries vol. 103, p 47-69, (October 1988).

Non-limiting examples of useful conditioning agents include those selected from the group consisting of petrolatum, fatty acids, esters of fatty acids, fatty alcohols, ethoxylated alcohols, polyol polyesters, glycerine, glycerin monoesters, glycerin polyesters, epidermal and sebaceous hydrocarbons, lanolin, straight and branched hydrocarbons, silicone oil, silicone gum, vegetable oil, vegetable oil adduct, hydrogenated vegetable oils, nonionic polymers, natural waxes, synthetic waxes, polyolefinic glycols, polyolefinic monoester, polyolefinic polyesters, cholesterols, cholesterol esters, triglycerides and mixtures thereof.

More particularly, the conditioning agent may be selected from the group consisting of paraffin, mineral oil, petrolatum, stearyl alcohol, cetyl alchohol, cetearyl alcohol, behenyl alcohol, C10-30 polyesters of sucrose, stearic acid, palmitic acid, behenic acid, oleic acid, linoleic acid, myristic acid, lauric acid, ricinoleic acid, steareth-1-100, cetereath 1-100, cholesterols, cholesterol esters, glyceryl tribehenate, glyceryl dipalmitate, glyceryl monostearate, trihydroxystearin, ozokerite wax, jojoba wax, lanolin wax, ethylene glycol distearate, candelilla wax, carnauba wax, beeswax, and silicone waxes.

Mineral oil, which is also known as petrolatum liquid, is a mixture of liquid hydrocarbons obtained from petroleum. See The Merck Index, Tenth Edition, Entry 7048, p. 1033 (1983) and International Cosmetic Ingredient Dictionary, Fifth Edition, vol. 1, p. 415-417 (1993).

Petrolatum, which is also known as petroleum jelly, is a colloidal system comprising nonstraight-chain solid hydrocarbons and high-boiling liquid hydrocarbons. See The Merck Index, Tenth Edition, Entry 7047, p. 1033 (1983); Schindler, Drug. Cosmet. Ind., 89, 36-37, 76, 78-80, 82 (1961); and International Cosmetic Ingredient Dictionary, Fifth Edition, vol. 1, p. 537 (1993).

Nonvolatile silicones such as polydialkylsiloxanes, polydiarylsiloxanes, and polyalkarylsiloxanes are also useful skin conditioning agents. These silicones are disclosed in U.S. Pat. No. 5,069,897, to Orr, issued Dec. 3, 1991.

Cationic Polymers

The present invention may also contain an organic cationic deposition polymer. Concentrations of the cationic deposition polymer preferably range from about 0.025% to about 3%, more preferably from about 0.05% to about 2%, even more preferably from about 0.1% to about 1%, by weight of the cleansing composition.

Suitable cationic deposition polymers for use in the present invention contain cationic nitrogen-containing moieties such as quaternary ammonium or cationic protonated amino moieties. The cationic protonated amines can be primary, secondary, or tertiary amines (preferably secondary or tertiary), depending upon the particular species and the selected pH of the personal cleansing composition. The average molecular weight of the cationic deposition polymer is between about 5,000 to about 10 million, preferably at least about 100,000, more preferably at least about 200,000, but preferably not more than about 2 million, more preferably not more than about 1.5 million. The polymers also have a cationic charge density ranging from about 0.2 meq/gm to about 5 meq/gm, preferably at least about 0.4 meq/gm, more preferably at least about 0.6 meq/gm., at the pH of intended use of the personal cleansing composition, which pH will generally range from about pH 4 to about pH 9, preferably between about pH 5 and about pH 8.

Nonlimiting examples of cationic deposition polymers for use in the personal care composition include polysaccharide polymers, such as cationic cellulose derivatives. Preferred cationic cellulose polymers are the salts of hydroxyethyl cellulose reacted with trimethyl ammonium substituted epoxide, referred to in the industry (CTFA) as Polyquaternium 10 which are available from Amerchol Corp. (Edison, N.J., USA) in their Polymer KG, JR and LR series of polymers with the most preferred being KG-30M.

Other suitable cationic deposition polymers include cationic guar gum derivatives, such as guar hydroxypropyltrimonium chloride, specific examples of which include the Jaguar series (preferably Jaguar C-17) commercially available from Rhodia Inc., and N-Hance polymer series commercially available from Aqualon.

Other suitable cationic deposition polymers include synthetic cationic polymers. The cationic polymers suitable for use in the cleansing composition herein are water soluble or dispersible, non crosslinked, cationic polymers having a cationic charge density of from about 4 meq/gm to about 7 meq/gm, preferably from about 4 meq/gm to about 6 meq/gm, more preferably from about 4.2 meq/gm to about 5.5 meq/gm. The select polymers also must have an average molecular weight of from about 1,000 to about 1 million, preferably from about 10,000 to about 500,000, more preferably from about 75,000 to about 250,000.

The concentration of the cationic polymer in the personal care composition ranges from about 0.025% to about 5%, preferably from about 0.1% to about 3%, more preferably from about 0.2% to about 1%, by weight of the composition.

A nonlimiting example of a commercially available synthetic cationic polymer for use in the cleansing composition is polymethyacrylamidopropyl trimonium chloride, available under the trade name POLYCARE 133, from Rhodia, Cranberry, N.J., U.S.A.

Cationic Surfactants

Cationic surfactants are typically categorized as non-lathering surfactants but may be used in the articles of the present invention provided they do not negatively impact the desired benefits of the articles.

Nonlimiting examples of cationic surfactants useful herein are disclosed in McCutcheon's, *Detergents and Emulsifiers*, North American edition (1986), published by allured Publishing Corporation; and McCutcheon's, *Functional Materials*, North American Edition (1992); both of which are incorporated by reference herein in their entirety.

Nonlimiting examples of cationic surfactants useful herein include cationic alkyl ammonium salts such as those having the formula:

$$R_1R_2R_3R_4N^+X^-$$

wherein $R_1$, is selected from an alkyl group having from about 12 to about 18 carbon atoms, or aromatic, aryl or alkaryl groups having from about 12 to about 18 carbon atoms; $R_2$, $R_3$, and $R_4$ are independently selected from hydrogen, an alkyl group having from about 1 to about 18 carbon atoms, or aromatic, aryl or alkaryl groups having from about 12 to about 18 carbon atoms; and X is an anion selected from chloride, bromide, iodide, acetate, phosphate, nitrate, sulfate, methyl sulfate, ethyl sulfate, tosylate, lactate, citrate, glycolate, and mixtures thereof. Additionally, the alkyl groups can also contain ether linkages, or hydroxy or amino group substituents (e.g., the alkyl groups can contain polyethylene glycol and polypropylene glycol moieties).

More preferably, $R_1$ is an alkyl group having from about 12 to about 18 carbon atoms; $R_2$ is selected from H or an alkyl group having from about 1 to about 18 carbon atoms; $R_3$ and $R_4$ are independently selected from H or an alkyl group having from about 1 to about 3 carbon atoms; and X is as described in the previous paragraph.

Most preferably, $R_1$ is an alkyl group having from about 12 to about 18 carbon atoms; $R_2$, $R_3$, and $R_4$ are selected from H or an alkyl group having from about 1 to about 3 carbon atoms; and X is as described previously.

Alternatively, other useful cationic surfactants include amino-amides, wherein in the above structure $R_1$ is alternatively $R_5CO—(CH_2)_n—$, wherein $R_5$ is an alkyl group having from about 12 to about 22 carbon atoms, and n is an integer from about 2 to about 6, more preferably from about 2 to about 4, and most preferably from about 2 to about 3. Nonlimiting examples of these cationic emulsifiers include stearamidopropyl PG-dimonium chloride phosphate, stearamidopropyl ethyldimonium ethosulfate, stearamidopropyl dimethyl (myristyl acetate) ammonium chloride, stearamidopropyl dimethyl cetearyl ammonium tosylate, stearamidopropyl dimethyl ammonium chloride, stearamidopropyl dimethyl ammonium lactate, and mixtures thereof.

Nonlimiting examples of quaternary ammonium salt cationic surfactants include those selected from the group consisting of cetyl ammonium chloride, cetyl ammonium bromide, lauryl ammonium chloride, lauryl ammonium bromide, stearyl ammonium chloride, stearyl ammonium bromide, cetyl dimethyl ammonium chloride, cetyl dimethyl ammonium bromide, lauryl dimethyl ammonium chloride, lauryl dimethyl ammonium bromide, stearyl dimethyl ammonium chloride, stearyl dimethyl ammonium bromide, cetyl trimethyl ammonium chloride, cetyl trimethyl ammonium bromide, lauryl trimethyl ammonium chloride, lauryl trimethyl ammonium bromide, stearyl trimethyl ammonium chloride, stearyl trimethyl ammonium bromide, lauryl dimethyl ammonium chloride, stearyl dimethyl cetyl ditallow dimethyl ammonium chloride, dicetyl ammonium chloride, dicetyl ammonium bromide, dilauryl ammonium chloride, dilauryl ammonium bromide, distearyl ammonium chloride, distearyl ammonium bromide, dicetyl methyl ammonium chloride, dicetyl methyl ammonium bromide, dilauryl methyl ammonium chloride, dilauryl methyl ammonium bromide, distearyl methyl ammonium chloride, distearyl dimethyl ammonium chloride, distearyl methyl ammonium bromide, and mixtures thereof. Additional quaternary ammonium salts include those wherein the C12 to C22 alkyl carbon chain is derived from a tallow fatty acid or from a coconut fatty acid. The term "tallow" refers to an alkyl group derived from tallow fatty acids (usually hydrogenated tallow fatty acids), which generally have mixtures of alkyl chains in the C16 to C18 range. The term "coconut" refers to an alkyl group derived from a coconut fatty acid, which generally have mixtures of alkyl chains in the C12 to C14 range. Examples of quaternary ammonium salts derived from these tallow and coconut sources include ditallow dimethyl ammonium chloride, ditallow dimethyl ammonium methyl sulfate, di(hydrogenated tallow) dimethyl ammonium chloride, di(hydrogenated tallow) dimethyl ammonium acetate, ditallow dipropyl ammonium phosphate, ditallow dimethyl ammonium nitrate, di(coconutalkyl)dimethyl ammonium chloride, di(coconutalkyl)dimethyl ammonium bromide, tallow ammonium chloride, coconut ammonium chloride, stearamidopropyl PG-dimonium chloride phosphate, stearamidopropyl ethyldimonium ethosulfate, stearamidopropyl dimethyl (myristyl acetate) ammonium chloride, stearamidopropyl dimethyl cetearyl ammonium tosylate, stearamidopropyl dimethyl ammonium chloride, stearamidopropyl dimethyl ammonium lactate, and mixtures thereof.

Preferred cationic surfactants useful herein include those selected from the group consisting of dilauryl dimethyl ammonium chloride, distearyl dimethyl ammonium chloride, dimyristyl dimethyl ammonium chloride, dipalmityl dimethyl ammonium chloride, distearyl dimethyl ammonium chloride, and mixtures thereof.

Methods

Lather Volume Test

The self-inflating article of the present invention can be cleansing or non-cleansing, and can be lathering or nonlathering with different lather profiles as described below. The Lather Volume Test provides a measure of the lather profile of an article in the presence of a substantial water supply, a condition such as naturally exists during bathing or showering. Without being limited by theory, by separating lathering components from gas evolving materials, preferred lathering articles exhibit high lather volumes. The lather profile described herein is a combination of the Flash Lather Volume and the Maximum Lather Volume, both of which are determined in accordance with the following Lather Volume Test.

An Erlenmeyer flask is chosen which has gradations every 50 ml. The flask has a nominal volume of 1,000 ml and measures 12.8 cm outside diameter (o.d.) at its widest point; has a height of 21.7 cm; a neck diameter of 4.3 cm (o.d.); and a neck length of 5.0 cm (for example Pyrex No. 4980). The accuracy of the volume gradations on the flask is verified. 150 grams of distilled water (±0.2 grams, at 23° C.) is added to the flask. The flask is secured upright in a rotating tumbler apparatus in a vertical position, which rotates the flask about a horizontal axis transecting the flask about 7.5 cm measured down from the top of the flask. A self-inflating article of the present invention is activated by commencing the gas evolving reaction at the same time the article is added into the flask, activating by releasing one or more components from a rupturable reservoir (e.g., by bursting a frangible rupturable reservoir to start the gas evolving reaction), or by merely adding the article to the water (if external water is used to activate the gas evolving reaction). The article is pushed through the neck into the enlarged, bottom area of the flask. The opening to the flask is sealed, for example with a stopper or with polyethylene film and elastic bands. The flask is rotated about the horizontal axis by the tumbler apparatus starting within 20 seconds of activating the gas evolving reaction, for 25 rotations or revolutions at a rate of 50 revolutions per 88 seconds in order to generate a lather, which is comprised of foam cells, and stopped in a vertical position to complete a first rotation sequence. After 15 more seconds, the height of the lather is observed according to the hash marks on the outside of the flask, and is recorded as the first lather volume, to the nearest 25 ml. Foam cells larger than 0.5 inches diameter in any direction are discounted. The height of the lather is the total uninterrupted height (i.e., volume as indicated on the flask) from the base of the flask to the top of the lather surface, the lather resting on water at the flask bottom. Thus, the minimum lather height (i.e., no lather) is the height of the water, or 150 ml. The maximum lather volume by definition is 1,000 ml. For articles with low lather amounts, i.e., less than 300 ml, the height can be measured with a ruler and the lather volume determined according to the gradations on the flask. If the article is resting on the lather, the height of the article is not considered as the lather height, but if the article rests within (under) the lather, the article is not considered and the lather height is recorded as if the article were not there. The lather height is the height of a level surface. If the top surface of the lather is uneven or not level, the lowest height at which it is possible to see halfway across the flask is the lather height and is recorded as the lather volume. Lather that collects on the top of the flask is not considered.

Excess pressure in the flask is relieved by opening the seal at the top momentarily, then resealing. After a total of 30 more seconds elapsed stoppage time, the flask is rotated a second 25 rotations. The lather volume is recorded in the same manner as before, as the second lather volume. After relieving excess pressure again, and after 30 more seconds of elapsed stoppage time, the flask is rotated a third 25 rotations, and the lather volume is recorded in the same manner as previous. The Flash Lather Volume is the first lather volume recorded, after the first 25 rotations. The Total Lather Volume is the sum of the lather volumes recorded after the first, second and third rotations.

Rigidity Test

Preferred articles are those that are sufficiently rigid which contributes to improved handleability of the articles. The articles are capable of being expanded at the point of use, having a high volume during use.

It is desirable to be able to move the articles over surfaces during use without the articles buckling or rolling up during use, i.e., bending. The ability of an article to remain flat and resist bending can be measured by an engineering test known as Three Point Bending (e.g., as described in ASTM Standard D 790-99, "Flexural Properties of Unreinforced and Reinforced Plastics and Electrical Insulating Materials"). Other nonwoven tests, such as the Handle-O-Meter Test (Thwing-Albert Instrument Company, Philadelphia, Pa.) rely on the basic principle of resistance to bending, as measured in 3-point bending mode. An advantage to measuring Three Point Bending instead of the Handle-O-Meter Test is that Three Point Bending can be measured in any web direction, determining properties in the machine direction separately from the cross machine direction. Properties in these two directions are often different for machine made articles, and result in variations in use of the articles which cannot be explained by the simpler measurements. Three Point Bending of materials produces data relating the stress-strain properties of the materials. Because it is common to test materials of differing length, thickness and width, equations are used to reduce data to common units for comparison. For Three Point Bending, Equation 1 can be used, and can be combined with Equation 2 for a rectangular strip of material. When the article is not rectangular, average measurements (e.g., average width of a non-rectangular article) can be substituted into the equations.

$$E = \frac{(F)(L)^3}{(v)(6)(I)} \qquad \text{Equation 1}$$

$F$ = force $L$ = length of article $I$ = moment of inertia of article $v$ = displacement $E$ = elastic modulus ofmaterial $$I = \frac{(b)(h)^3}{12} \qquad \text{Equation 2}$$

$b$ = width of article $h$ = thickness of article

The expression (F/((b)(v)) is an important component of the rigidity of a nonwoven article as it relates to its ability to resist bending, and (F/((b)(v)) (i.e., rigidity) is directly available from Three Point Bending testing as the slope in Three Point Bending (Force per displacement), divided by the width of the article tested. Inventors have found that when this slope is within a certain ranges, cleansing articles resist bending during use without becoming too rigid for comfortability, making the articles easier to handle. Further, thickness of articles (h) is also an integral component of rigidity, the expressed rigidity scaling as a cubic function of thickness.

$$\frac{F}{((b)(v))} = \frac{(E)(h)^3}{(2)(L)^3} \qquad \text{Equation 3}$$

Three Point Bending Rigidity Method

Three Point Bending Rigidity of articles is measured using a Texture Analyzer model TA-xt2i (Texture Technologies, Scarsdale, N.Y., USA) with a 5 kg load cell, and a three point bending geometry.

A lower stage is established for the test, consisting of two parallel beams each having a diameter (o.d.) of 1.05 inches. Schedule 40 pipe having a ¾ in. i.d. is widely available, easy to use, and may be suitable for fabricating the lower stage. The lower stage is prepared so that the beams are fixed in a parallel position having a gap between them measuring 80.00 mm at the narrowest point (106.7 mm apex to apex). The length of the beams is sufficient that an article may be balanced on the beams and be fully supported with the substrate clear of any support structures used to fix the beams in position. A length of 10 inches is effective for the beams. The lower stage is set in place at the base of the Texture Analyzer in a position high enough that an upper beam can penetrate through the space between the parallel beams of the lower stage during a measurement at a point midway between the lower beams.

An upper stage is prepared, which comprises a T-shaped upper beam, having a measurement section and a bisecting section. The measurement section of the T-shaped upper beam is the middle beam as conventionally described in Three Point Bending literature, and the bisecting section is used to affix the T-shaped upper beam to the Texture Analyzer TA-xt2i. The upper beam has an outer diameter measuring 1.305 inches and a length measuring 3.10 inches, measuring the central measurement section of the beam. The upper stage is affixed to the upper movable arm of the Texture Analyzer TA-xt2i in a position so that the measurement section (i.e., the middle beam of the Three Point Bending geometry) of the upper beam is parallel to the two parallel beams of the lower stage, all of which are positioned horizontally. The stages are fixed in position so that as the upper beam is lowered by the Texture Analyzer TA-xt2i, the upper beam advances vertically (downward) so that the measurement section intersects the plane of the lower stage midway between the parallel beams of the lower stage; and the advancement of the upper beam movement is in a direction perpendicular to the plane formed by the parallel beams of the lower stage. The upper beam is set at a starting position, which is a height where the lowest portion of the upper beam is 40 mm above the highest portion of the parallel beams of the lower stage. The instrument is calibrated properly and set to measure at an upper beam (i.e., Texture Analyzer TA-xt2i upper arm speed) velocity of 10 mm per second in a downward direction, measuring the force in compression. The instrument is programmed to travel a distance of 60 mm, collect force and displacement data (100 points per second minimum) and return to the starting position.

Three Point Bending Rigidity for articles comprising a lathering surfactant component is measured for articles from which the lathering surfactant composition has been substantially removed, unless removal of the lathering component activates the gas evolving material. If the chemical component does not contribute substantially to the bending modulus, the articles can be measured without removal of any chemical components contained therein. Chemical components such as lathering surfactants can be removed by rinsing, followed by drying the article.

An article is placed on the lower beams of the 3 point bending apparatus with the longest direction perpendicular to the lower beams, and is centered on the beams in a position immediately below the upper beam. If the article is too short to be supported by the lower beams at the indicated width, the lower beams are adjusted inward until the article is supported at the apex of the lower beams and the test is continued, and Equations 1 and 2 are used to subsequently adjust values obtained to an 80 mm lower beam distance, which is standard for this test, by multiplying values obtained as described below by the cube of the ratio of the lower beam apex-to-apex distance ($L^3$) divided by the cube of the same apex-to-apex distance when the lower beams are 80 mm minimum distance apart (i.e., multiply by $(L/mm)^3/(106.7\ mm)^3$. The values adjusted to the 80 mm minimum distance are the values determined by the Rigidity Test. The upper beam advances at a rate of 10 mm/sec downward, at first contacting and then bending the article, collecting force-displacement information. The results are plotted as force (F, y-axis in grams) and displacement (v, X-axis in centimeters). Displacement is plotted as its absolute value so that it is increasing and positive with downward movement with the upper beam, so that the slope of the line is positive. The rigidity is determined from a graph of the results. The results have a first portion where F is essentially equal to zero (prior to contact); and a second portion where F is greater than zero and increasing. The slope is determined between the point where the force reaches 3.0 grams force and the point where the force is a maximum, where the maximum force (Max. Force) and displacement (Displacement at Max. Force) are recorded. The slope is determined for the test according to the following equation.

$$\text{Slope}=(\text{Max. Force}-3.0\ \text{gm})/(\text{Displacement at Max. Force}-\text{Displacement at 3.0 gm})$$

The slope obtained is then divided by the width of the article to obtain the Rigidity, which is expressed in units of grams/cm/cm (i.e., grams force per cm displacement per cm of article width).

The highest force during the measurement is also obtained, and is divided by the width of the article to obtain the Peak Force, expressed in grams per cm (i.e., grams force at the peak per width of article).

Permeability Test

The articles of the present invention comprise an inflatable bladder that comprises a substrate comprising a first layer and a second layer comprising a web which comprises a sack wherein the substrates exhibit low water permeability and are preferably impermeable to (liquid) water. The inflatable bladder has layers which have low or essentially no liquid water permeability The Permeability Test measures the water permeability of a substrate, layers, walls, or composite layers used to limit water transport and maintain elevated gas pressure internal to the bladder for the duration of a useage event. Without intending to be limited by theory, bladder layers having low permeability increase the ability of the article to maintain pressure during use, which improves properties such as rigidity; and minimizes the amount of gas evolving materials necessary in the article. For example, articles of the present invention may only require about 50 grams of sodium bicarbonate per square meter of web area or less to be effective. Additionally, low permeability reduces the impact of gas evolving materials on lather by separating potentially deleterious salts which can form from the gas evolving reaction from the lathering component. Further, articles with low permeability can maintain internal pressure in the bladder during a useage event, and subsequently depressurize for easier disposal. Also without intending to be limited by theory, articles of the present invention having a bladder which is impermeable to liquid water are preferred because the article can be stored in an environment where water is present without detrimental effect on the long term stability of the article and the ability of the article to have evolving gases. For example, the package containing the article may not need to be completely sealed against environmental water for such an article. For articles with an inflatable bladder comprising different webs in different layers, each web or layer is measured according to the Permeability Test.

In order to measure the Permeability of a web, affix a web using tape or rubber bands to the bottom of a plastic funnel with the following measurements: a 24 mm inner diameter (i.d.) at the exit (neck), a 145 mm i.d. at the top, 135 mm total height with a 20 mm length neck, and a total volume of slightly greater than 600 ml. Apply sufficient tension to the web to ensure that it is completely flat, and no more (i.e., do not stretch the substrate). Affix tape or elastic bands as close as possible to the exit of the funnel to keep backflow from occurring under water pressure at the edges of the funnel. Next, place the funnel in a ringstand over a sink. Measure out 600 ml of water at room temperature in a graduated cylinder. Then, with one hand blocking the funnel exit, pushing against the test web, quickly pour the water into the funnel. The water is not yet allowed to drain. Once the funnel is filled, remove the hand blocking the exit and measure the amount of time for the water to evacuate the funnel to the nearest tenth of a second. Stop timing when the water surface reaches the junction at the neck and the sloped portion of the funnel. Repeat this process 5 times per test web and obtain a representative average. Webs are measured in both directions if the top and bottom are different, and the results averaged to obtain the average time in seconds for the water to flow. Permeability is expressed in $cm^3$-/$cm^2$/sec according to the following equation:

$$\text{Permeability}=(600\ cm^3\ \text{water})/\{(\text{pi})\times(1.2\ cm)^2\times(\text{average time in seconds})\}$$

Webs which exhibit long drainage times (greater than 10 minutes for 600 ml) are tested by weighing the water drained in a set time period, e.g., 5 minutes, with the funnel containing 600 ml of water. Permeability is then calculated using the volume measured (in place of 600 $cm^2$) and the drainage time allowed (instead of the average time in seconds) in the above equation. If no liquid water drains through the web, the average time in seconds is infinite and the Permeability is determined to be 0 (zero).

If a web is measured and determined to have zero permeability, permeability is checked a second time after first wetting the web with a surfactant solution, for example a 10% solution of Dawn ® dishwashing liquid, and repeating the Permeability Test after surfactant exposure.

Expansion and Thickness Tests

Articles can advantageously be prepared, packaged and stored at low thickness, then activated by the consumer so that the activated articles have increased thickness during use. It is desirable to have a certain amount of thickness and to maintain the thickness when grasping the article and moving it against the skin, which adds pressure. Preferred articles maintain thickness even under a considerable amount of pressure.

Thickness of articles, and Expansion Ratio of articles, is measured using a Texture Analyzer model TA-xt2i (Texture Technologies, Scarsdale, N.Y., USA) with a 5 kg load cell, and an upper plate measuring 4 in. by 3.5 in. positioned over a (large) lower base plate. The flat, rectangular upper plate is positioned on the Texture Analyzer in a position parallel to the lower base plate, both plates positioned horizontal to the ground. The upper plate is positioned so that it begins 30 mm above the lower base plate, calibrated so that the point of contact is the zero height point (using 10 grams force to set the zero point). The upper plate is calibrated so that it reads zero force at the start of the testing while not in contact with anything. The upper plate is programmed using the Texture Analyzer software to advance towards the lower plate at a rate of 5 mm/second, measuring force and distance (or time, translated into distance afterward). Distance is translated into height above the base plate by subtracting the distance obtained (mm) from the 30 mm starting point, to obtain height above the base plate. The upper plate is programmed to advance until a force of 200 grams is reached, then return to its original position.

Thickness is first measured on an article prior to inflating, i.e., in the condition of the article prior to use. The article is placed on the lower plate and positioned in the center of the contact zone (where the plates meet) so that the maximum amount of contact area is made between the article and the descending upper plate. The upper plate descends until 200 gm force is obtained, and the distance traveled by the upper plate is subtracted from 30 mm to obtain the distance between the plates at 200 gm force, which is the Pre-Inflation Thickness of the article.

If an article contains an interior or distinct reservoir area which is thicker than the surrounding nonwoven, such as an internal foil reservoir, thickness is measured not inclusive of the reservoir (for example by removing the reservoir prior to measuring, and subsequently testing a different article to obtain the Inflated Thickness).

Thickness of the inflated article is measured. The article is inflated (i.e., activated) to maximize the thickness of the article, in a manner consistent with the intended use of the article. Inflating to maximum thickness may involve commencing a gas evolving reaction and waiting for a period of time until thickness reaches a maximum; or wetting an article and waiting a set time period. The inflated article at its maximum thickness is placed on the lower plate of the Texture Analyzer in the same manner as previously described, and thickness is measured at 200 gm force, which is the Inflated Thickness.

Thickness of the article at high pressure is measured. An article is inflated, and after 5 minutes, thickness of the article at a force of 2,000 grams is measured using the Texture Analyzer and the same conditions as previously indicated, with a 2,000 gram force. Thickness of the inflated article at 2,000 grams force is the High Pressure Thickness, and is expressed in mm. Articles which substantially retain their thickness at a high pressure are especially useful for cleansing large surfaces, such as the body in a shower or bath.

Expansion Ratio of the article is calculated from the thickness of the article, according to the following equation:

$$\text{Expansion Ratio}=100\% \times(\text{Inflated Thickness})/(\text{Pre-Inflation Thickness})$$

Articles of the present invention have an Inflated Thickness of preferably greater than 2 mm, more preferably greater than about 3 mm, even more preferably greater than about 4 mm, still more preferably greater than about 6 mm, still even more preferably greater than about 8 mm, and most preferably greater than about 10 mm.

Kits

The self-inflating articles of the present invention may also be packaged individually or with multiple articles. A kit containing the self-inflating articles of the present invention are placed in a package wherein the kit can be placed in a wet and dry environment. A kit for the use of a self-inflating personal care article for cleansing the skin and other keratinous surfaces, said kit comprising:

a) a self-inflating article comprising,
   1. an inflatable bladder comprising a substrate;
   2. at least one rupturable reservoir associated within said inflatable bladder; and
   3. a cleansing composition;

b) a container having a seal that is removed prior to first use of the article, said container having a cover wherein the cover protects the products not in use.

In a preferred embodiment the article has a third layer comprising a web that comprises a cleansing composition associated with at least one surface of the third layer. The third layer is in communication with and juxtaposed to the second layer.

In an additional preferred embodiment, the article has a fourth layer in communication with and juxtaposed to the third layer. The fourth layer comprises high loft material. As used herein, "loft" means that the layer has density of from about 0.00005 g/cm$^3$ to about 0.1 g/cm$^3$, preferably from about 0.001 g/cm$^3$ to about 0.09 g/cm$^3$ and a thickness of from about 0.1 mm to about 30 mm. Additionally, the high loft material of the fourth layer comprises a cleansing composition associated with the fourth layer.

Methods of Use

Methods for cleansing body surfaces involves having a user apply sufficient force to break the rupturable reservoir that initiates a reaction that evolves gas to inflate the bladder. Users of the self-inflating personal care article containing the gas evolving composition and preferably a cleansing composition, generate foam and lather from the article and place the article in contact with their skin surfaces. The article is particularly useful in the context of cleansing the body during bathing and, or showering.

Method of Manufacture

Articles of the present invention are manufactured involving the steps of:

1. Enclosing a liquid, preferably water or an aqueous solution of water and at least one gas evolving reactant, in a rupturable reservoir having a means of releasing the contents,
2. Contacting two surfaces of a first layer and second layer together to form a space therebetween,
3. Adding at least one rupturable reservoir to the space between the layers of the inflatable bladder including within a rupturable reservoir and optionally a dry or liquid second material or composition to the same space,
4. Forming a seal around a perimeter to make a sack containing the rupturable reservoir or reservoirs,
5. Cutting the web into an individual article.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. All exemplified amounts are concentrations by weight of the total cleansing, treatment compositions, unless otherwise specified.

The following substrates, layers or composite layers are used to prepare articles in the examples below.

The following surfactants compositions are used to prepare articles of the present Surfactant Composition 1 (Paste)

A dual textured lathering cloth for cleansing the body in a shower can be prepared. A lathering surfactant component comprising 33.1% active surfactants can be prepared from the following ingredients.

| Ingredient | Supplier or common CTFA name | Amount added |
|---|---|---|
| Sodium lauryl sulfate (SLS) 29% active solution | (Stepan Chemical, Northfield, IL, USA) Stepanol WA-EXTRA | 21.9% |
| Sodium Laureth Sulfate 70% active | (Stepan Chemical) STEOL CS-270 | 29.1% |
| Citric Acid Anhydrous | Citric acid | 0.2% |
| Cocamidopropyl betaine 30% active | (Stepan Chemical) AMPHOSOL CG | 21.4% |

-continued

| Ingredient | Supplier or common CTFA name | Amount added |
|---|---|---|
| Water | | 25.3% |
| JR30M | (Amerchol) Polyquaternium-10 | 0.5% |
| Perfume | | 1.2% |
| Preservative, colorants & misc. | | 0.4% |

Surfactant Composition 2 (Hotmelt)

The composition can be prepared by mixing the cationic polymer with the glycol and surfactants under heat with continuous stirring to avoid lumps. The perfume is added during cooling. The lathering surfactant component melts upon heating to about 60 degrees C. or more, and solidifies upon cooling to a hard solid.

| Ingredient | Supplier or common CTFA name | Amount of Ingredient Added (including water it contains) |
|---|---|---|
| Alkyl Glyceryl Sulfonate (AGS) 47.5% solids paste | (Procter & Gamble Co., Iowa City, Iowa, USA) | 62.8% |
| Cocamidopropyl | (Stepan Chemical) | 19.7% |

| | |
|---|---|
| "Avgol" "Heat SELF Avgol" | A fibrous nonwoven web which is 100% polypropylene fibers prepared by a spunbond/spunlace process, having a basis weight of 50 gsm, manufactured by Avgol Nonwovens, Greensboro, NC, USA. "Heat SELF Avgol" is same material processed using interlocking plates having a diamond pattern comprising parallel ridges stamped into the web using plates having 266/320° F. top/bottom plate temperatures with a 1 second dwell time. The pattern is permanently fixed into the web and the web has an exfoliating character when used on the skin. |
| "BBA" | A core-sheath bicomponent fiber (PE/PP) spunbond web having a basis weight of 46 gsm, manufactured by BBA Nonwovens, Simpsonville, NC, USA. |
| "PE Film" | Low density polyethylene resin (LDPE) film, having specified thickness in mil (.001 in.). Transparent or opaque (white or colored). Representative films available from Tredegar, Inc., Terre Haute, IN, USA. |
| "EVA Monolayer Film" | nominal 1 mil thick EVA (ethylene vinyl acetate) film having >500% extension at tensile failure, e.g., Solastic K5112.010 EVA 25 micron film (opaque, pink) manufactured by Nordenia Deutschland, Gronau, GmbH, Germany |
| "batting" | Lofty, low density batting comprising 50% hollow PET fibers and 50% PE/PET core/sheath bicomponent fibers, heat set, at specified basis weights. |
| "barrier grade meltblown" | 35 gsm, fine denier, barrier grade meltblown web prepared by Fiberweb Group of BBA Nonwovens, Simpsonville, NC |
| "Clopay Film" | Clopay breathable adhesive laminate, 2.5 mil thick, having an MVTR of 2,000 gm/m$^2$ (ASTM E96E), manufactured by Clopay Plastic Products, Mason, OH, USA |
| "Volara ® Foam" | A closed cell, impermeable, flexible polyethylene foam having a basis weight of 84 gsm, a density of 6 pcf (pounds per cubic foot), manufactured by Voltek, Lawrence, MA, USA |
| "Open Cell Foam" | A porous, open cell foam having a thickness of 0.25 in., a basis weight of 226 gsm, with checkerboard shape lines melted into the material using an impulse bar sealer to reduce the open are of the foam by half. |
| "Diaper Backsheet" | A diaper backsheet having permeability to water vapor, comprising polyethylene film was removed from a commercial diaper (Luvs ®). |

-continued

| Ingredient | Supplier or common CTFA name | Amount of Ingredient Added (including water it contains) |
|---|---|---|
| Betaine, 30% active | AMPHOSOL CG | |
| Citric Acid Anhydrous | Citric acid | 0.2% |
| Propylene Glycol | Propylene glycol | 15.2% |
| Polyox WSR-301 | (Amerchol) PEG 90M | 0.20% |
| N-Hance 3196 cationic polymer | (Aqualon-Hercules, Irvine, CA, USA) cationic guar or guar hydroxypropyltrimonium chloride (polymer) | 0.50% |
| Perfume | | 1.0% |
| Preservative & misc. | | 0.4% |

Surfactant Composition 3 (Spray or Dip)

The component phase B can be prepared in water and the petrolatum emulsified into the component phase B at 75° C. to make a 25% solids aqueous mixture of phase A +B, which is surfactant composition 3. The formula shown does not include the added water.

| Ingredient common name or trade name | Ingredient CTFA name | CAS # | % active chemical added | Phase |
|---|---|---|---|---|
| Petrolatum (Witco) | Petrolatum | 8009-03-8 | 32.3 | A |
| Cocamidopropyl Hydroxysultaine | Cocamidopropyl Hydroxysultaine | 68139-30-0 | 11.7 | B |
| Hamposyl L-30 (Hampshire Chem) | Sodium Lauroyl Sarcosinate | 137-16-6 | 11.7 | B |
| Plantaren 2000 N UP (Cognis Care Chemicals, NJ, USA) | Decyl Glucoside | mixture | 11.7 | B |
| Beta CycloDextrin | Beta CycloDextrin | 7585-39-9 | 5.0 | C |
| Butylene Glycol | Butylene Glycol | 107-88-0 | 3.6 | B |
| Polyox WSR N3000 (Amerchol) | PEG 14M | 25322-68-3 | 1.8 | B |
| Ucare Polymer JR30M (Amerchol) | Polyquaternium-10 | 53568-66-4 | 0.9 | B |
| D-Panthenol | Panthenol | 81-13-0 | 0.7 | B |
| Salicylic Acid | Salicylic Acid | 69-72-7 | 0.2 | B |
| Misc. preservatives, vitamins | | mixture | 1.99 | B |

Rupturable reservoirs can be prepared containing 33.3% citric acid dissolved in water. The rupturable reservoir is formed from Pechiney metallized film #E-13123-02 comprising foil, LDPE and butylenes. The rupturable reservoirs are sealed using 145° C. jaw temperature to create seals on 2 edges and 106° C.-110° C. jaw temperature on a third edge, the rupturable reservoir being formed from a tube so requiring only 3 sealed edges. The film is available from Pechiney Plastic Packaging, Chicago, Ill., USA. The rupturable reservoirs are rupturable with a force of between a few Newtons and 25 Newtons, preferably 4 Newtons to 14 Newtons, sufficient to last through distribution of a consumer product yet be easily ruptured by hand pressure during use. Rupturable reservoirs are filled with either 0.5, 1.0, 1.5, or 2.0 ml of 33.3% citric acid dissolved in water. The 1.5 ml rupturable reservoirs measure about 2.0 cm×2.5 cm, excluding the seal area, and have a thickness of about 0.4 cm at the center. The 2.0 ml rupturable reservoirs are about 2.1 cm×3.4 cm excluding seal area. Rupturable reservoirs which are thicker (e.g., 0.4 cm thick or greater) are easier to locate and rupture when placed internal to the article. A means to facilitate rupture can also be located on, in, or near the rupturable reservoir, such as any hard or sharp component such as a plastic nub.

Rupturable reservoirs can be prepared with water, dissolved acids, or dissolved alkali metal carbonates, or other components involved in releasing gases or reacting to release gases when ruptured. Rupturable reservoirs can be prepared which have dual compartments. Two or more rupturable reservoirs with different components can also be prepared and added to an inflatable bladder. Rupturable reservoirs with two or more reservoirs can be in a side by side or superimposed configuration, so long as contents are able to be released interior to the inflatable bladder.

Articles can be sealed as indicated in the following examples. Unless otherwise specified, a perimeter is sealed which is a rectangle using a Vertrod electrical impulse sealer or the equivalent having a sealing jaw with heat on both sides of the jaws, which seals a 4 mm width at each article edge. Articles can also be sealed utilizing heat, pressure, combinations of heat and pressure, including heat generated by means such as ultrasonically. Articles are cut exterior to the sealed area, leaving an uncut edge a few mm from the seal. Unless otherwise specified, article dimensions are 79 mm×130 mm rectangles, measuring the transverse dimensions inside the seal area; and about 97 mm×148 mm measuring to the exterior of the article from side to side.

Example 1

A toddler skin cleansing article can be prepared. Prepare a bladder comprising a first layer and a second layer of 2 mil PE film on each side. Place in the interior of the article a composition comprising about 0.55 gm of sodium bicarbonate and the rupturable reservoir containing 1.5 ml of 33.3% citric acid solution. Tape the rupturable reservoir to a location against the PE film. Laminate Avgol to one exterior side and batting to another exterior side. Seal the article in a continuous perimeter in the shape of a frog utilizing a pressure-platen heat sealing device such as a Sentinel Model 808 heat sealer available from Sencorp, Hyannis, Mass., USA, with a sealing die with a 4 mm thick sealing rim, having a surface area internal to the seal of about 85 $cm^2$. Seal dots (5 mm diameter) in the center and at the eye of the frog shape. Cut the article, leaving about 4.5 mm of excess substrate trim exterior to the perimeter seal, to keep edges from scratching the skin during use. Apply 6.5 grams (wet weight) of surfactant composition 1 to the article, drying the article overnight at 120° F. and 5% humidity.

Active the article by rupturing the internal rupturable reservoir and use for cleansing the skin and hair. Upon rupturing the internal rupturable reservoir, the article fizzes, i.e., making a noise indicating the article is working.

Examples 2-6

Articles having 4 layers can be prepared according to the following table:

| Example | Layer 1 | Layer 2 | Layer 3 | Layer 4 |
|---|---|---|---|---|
| 2 | Avgol | PE Film, 1 mil | PE Film, 1 mil | Batting, 84 gsm |
| 3 | Avgol | PE Film, 4 mil | PE Film, 4 mil | Batting, 84 gsm |
| 4 | Avgol | PE Film, 1 mil | PE Film, 1 mil | Batting, 84 gsm |

-continued

| Example | Layer 1 | Layer 2 | Layer 3 | Layer 4 |
|---|---|---|---|---|
| 5 | Avgol | PE Film, 1 mil | PE Film, 1 mil | Batting, 84 gsm |
| 6 | Avgol | PE Film, 1 mil | PE Film, 1 mil | Batting, 84 gsm |

Each article can be sealed using an electrical impulse bar sealer with heat on upper and lower jaws, on 4 sides in a rectangular shape, producing a 4 mm wide continuous seal around the article. The inflatable bladder comprises the inner 2 layers of the articles. Prior to sealing the final side of each article, a rupturable reservoir containing 2.0-2.2 ml of 33.3% citric acid solution will be placed within the bladder interior; and dry sodium bicarbonate will be added in the following amounts: Example 2, 0.41 gm (28 gsm); Example 3, 0.40 gm (28 gsm); Example 4, 0.40 gm (28 gsm); Example 5, 0.76 gm (28 gsm); Example 6, 0.40 gm (28 gsm). In addition to the perimeter seal, Examples 4, 5, and 6 are sealed with 1 mm diameter dot seals in the interior portion of the cloth, to hold the cloth shape during expansion and further increase rigidity for improved handleability. Dot seals are effected by a Bryant TAS 2020 sealer with 4.0-5.5 second dwell time at 390° F. set point, using Teflon sheet material between a flat sealing probe and the article. Sealing pattern and size of the articles is according to the following table.

| Example | Article dimensions inside seal area | Article outside dimensions | Dot seals |
|---|---|---|---|
| 2 | 79 mm × 130 mm | 99 mm × 150 mm | None |
| 3 | 79 mm × 130 mm | 99 mm × 150 mm | None |
| 4 | 79 mm × 130 mm | 99 mm × 150 mm | Three 1 mm dots in center, within 1 cm area |
| 5 | 125 mm × 165 mm | 145 mm × 185 mm | 7 dots in 3 rows (2-3-2) longitudinally, evenly spaced from each other |
| 6 | 79 mm × 130 mm | 99 mm × 150 mm | 1 dot in center |

Example 6 can be prepared with a small pinhole leak at one edge to determine the effect of a minor defect in the film quality and/or sealing quality on the properties of the article.

Surfactant components are added to the articles as follows:

Examples 2, 4, 5 and 6: 5.0 grams per article of surfactant composition 2 are added in stripes to the batting side, embedding in the lofty batting structure.

Example 3: 1.0 gram per article of surfactant composition 3 are added and the articles are dried 12 hours at 120° F and 5% humidity.

The examples 2-6 have the following properties.

Example 2

The article can be tested in the absence of a surfactant or other chemical component exterior to the bladder. Prior to activation, the article has a Pre-Inflation Thickness of 2.08 mm. The article has an Inflated Thickness of 15.7 mm, an Expansion Ratio of 755%, and a High Pressure Thickness of 12.5 mm. All sides of the bladder have a Permeability of 0 $cm^3/cm^2/sec$. Prior to activation the article has a Peak Force of 0.38 gm/cm and a Slope of 0.47 gm/cm/cm in the Three Point Bending Rigidity Test; after activation the article has a Peak Force of 31.3 gm/cm and a slope (Rigidity)of 7.62 gm/cm/cm.

Example 3

Prior to activation, the article has a Pre-Inflation Thickness of 3.76 mm. The article has an Inflated Thickness of 16.8 mm, an Expansion Ratio of 450%, and a High Pressure Thickness of 13.5 mm. All areas of the bladder have a Permeability of 0 $cm^3/cm^2/sec$. Prior to activation the article has a Peak Force of 1.26 gm/cm and a slope (Rigidity) of 1.18 gm/cm/cm in the Three Point Bending Rigidity Test; after activation the article has a Peak Force of 46.6 gm/cm and a slope (Rigidity) of 11.3 gm/cm/cm. The article has a Flash Lather Volume of 450 ml and a Total Lather Volume of 2,000 ml.

Example 4

Prior to activation, the article has a Pre-Inflation Thickness of 3.06 mm. The article has an Inflated Thickness of 12.5 mm, an Expansion Ratio of 400%, and a High Pressure Thickness of 9.5 mm. All areas of the bladder have a Permeability of 0 $cm^3/cm^2/sec$. The article has a Flash Lather Volume of 850 ml and a Total Lather Volume of 2,850 ml.

Example 5

Prior to activation, the article has a Pre-Inflation Thickness of 3.9 mm. The article has an Inflated Thickness of 17.7 mm, an Expansion Ratio of 450%, and a High Pressure Thickness of 12.3 mm. All areas of the bladder have a Permeability of 0 $cm^3/cm^2/sec$.

Example 6

Prior to activation, the article has a Pre-Inflation Thickness of 2.08 mm. The article has an Inflated Thickness of 12.91 mm, and an Expansion Ratio of about 620%. All areas of the bladder have a Permeability of 0 $cm^3/cm^2/sec$. Prior to activation the article has a Peak Force of 0.28 gm/cm and a slope (Rigidity) of 0.32 gm/cm/cm in the Three Point Bending Rigidity Test; after activation the article has a Peak Force of 4.97 gm/cm and a slope (Rigidity) of 1.27 gm/cm/cm. The article has a Flash Lather Volume of 300 ml and a Total Lather Volume of 1,750 ml. The pinhole leak at the seam may have been detrimental to the ability of the article to generate lather compared to articles of the present invention having no interaction of the salts generated at the bladder interior with the exterior lathering components. The high Expansion Ratio and useful properties in the Rigidity Test indicate articles with a very low pre-activated rigidity can become significantly more rigid and thick by expansion using entrapped gas.

Examples 7-13 can be prepared at the same size as the article in Example 2.

Example 7

An article can be prepared using EVA Monolayer Film for the inflatable bladder layers, and exterior layers the same as Examples 2-5. Add anhydrous sodium bicarbonate (0.40 gm) and anhydrous citric acid (0.35 gm) to the inner bladder layer. Prepare a rupturable reservoir comprising 2.5 ml water using the Pechiney metallized film. In addition to the perimeter seal, affix 4 small dots seals in a diamond array, approximately equidistant from each other and the edges of the article in the machine direction and cross machine direction, in order to give the article a mattress type of construction when inflated. Add three grams of surfactant composition 2 per article by slot coating onto the batting side only. Test the properties of the article in the absence of the surfactant component, which is washed away and the article dried prior to testing and activation. Prior to activation, the article has a Pre-Inflation Thickness of 3.10 mm. The article has an Inflated Thickness of 12.39 mm, and an Expansion Ratio of about 380%, and a High Pressure Thickness of 8.47 mm. All areas of the bladder have a Permeability of 0 $cm^3/cm^2/sec$. Prior to activation the article has a Peak Force of 0.30 gm/cm and a slope (Rigidity) of 0.14 gm/cm/cm in the Three Point Bending Rigidity Test; after activation the article has a Peak Force of 6.59 gm/cm and a slope (Rigidity) of 1.33 gm/cm/cm. The article is rigid, yet soft and easy to use on the skin. Thirty of the articles are prepared and stacked, and packaged in a bottom dispensing bag with a hanger for storage and use in the shower. The package is placed in a box for distribution, but upon opening is not sealed against environmental moisture due to the sequestration of the interior chemicals (i.e., gas evolving materials) in the bladder interior.

Example 8

An article can be prepared using Avgol and Heat SELF Avgol as exterior layers, and Clopay Film layers as the bladder. Prepare and add in the same manner and amount as Example 2 gas evolving materials (sodium bicarbonate, citric acid and water). Add between the Avgol and bladder layers, four grams of commercial soap bar (Zest® brand), flaked, half to each side of the article. In addition to the perimeter seal, affix in the center of the article a single dot seal (1 mm diameter point bond). Test properties of the article in the absence of the surfactant component, which is washed away and dry the article prior to testing and activation. Prior to activation, the article has a Pre-Inflation Thickness of 3.65 mm. The article has an Inflated Thickness of 13.48 mm, and an Expansion Ratio of about 370%, and a High Pressure Thickness of 10.98 mm. All areas of the bladder have a Permeability of 0 $cm^3/cm^2/sec$. The article remains inflated during showering, and over time deflates to facilitate disposal.

Example 9

An article can be prepared having the same exterior layers as Examples 2-6. The inflatable bladder comprises first impermeable layer, which is a 1 mil thick PE Film, against the Avgol exterior side. The inflatable bladder comprises a second layer which is barrier grade meltblown, a low permeability fibrous nonwoven having a Permeability of 2.05 $cm^3/cm^2/sec$ (which layer requires utilizing a solution of Dawn detergent to measure Permeability, as indicated in the Permeability Test). Add sodium bicarbonate (0.75 gm/article, or 53 gsm) between the meltblown and film layers along with a 2 ml rupturable reservoir containing 33.3% citric acid solution. Add surfactant in three lengthwise strips, 5.0 grams/article of surfactant composition 2, prior to sealing. Seal the perimeter in the same manner as Example 2, and cut the article to the same size as Example 2. Dry the article. Prior to activation, the article has a Pre-Inflation Thickness of 4.12 mm. Inflate the bladder by first lathering the article with a small amount of water to coat the batting and meltblown layers with a lather, then rupture the rupturable reservoir to activate the article. The article has an Inflated Thickness of 8.56 mm, and an Expansion Ratio of about 190%, and a High Pressure Thickness of 6.17 mm. The article has a Flash Lather Volume of 300 ml and a Total Lather Volume of 1,750 ml. The article has useful lather properties and expansion due to the combination of first impermeable layer and second layer having low permeability in the inflatable bladder, and flattens easily for disposal after use.

Example 10

An article can be prepared having the same exterior layers as Examples 2-6. The inflatable bladder comprises first impermeable layer, which is a 1 mil thick PE Film, against the Avgol exterior side. The inflatable bladder comprises a second impermeable layer which is a closed cell foam, the Volara® foam. Both layers of the inflatable bladder have a Permeability of 0 $cm^3/cm^2/sec$ in the Permeability Test. Add sodium bicarbonate (0.40 gm/article, or 28 gsm) and citric acid solution in a rupturable reservoir (2 ml) and effect a perimeter seal in the same manner as Example 2. Test the properties of the article without addition of an exterior chemical component of any kind, but is suitable for a wet wipe, a lotion application wipe such as a sunscreen or a skin care lotion comprising hydrophilic and hydrophobic skin conditioning agents, a pet care wipe, or a shampoo wipe. One does not need dry the article prior to packaging. Articles can be stored in a tub with a pop up lid. Prior to activation, the article has a Pre-Inflation Thickness of 4.28 mm. The article has an Inflated Thickness of 18.02 mm, and an Expansion Ratio of about 420%, and a High Pressure Thickness of 14.06 mm. Prior to activation the article has a Peak Force of 0.82 gm/cm and a slope (Rigidity) of 0.39 gm/cm/cm in the Three Point Bending Rigidity Test; after activation the article has a Peak Force of 47.2 gm/cm and a slope (Rigidity) of 11.00 gm/cm/cm. The high rigidity after activation make the article particularly useful for application of skin care components to the skin, and compression of the batting layer by expansion of the bladder ensure nearly all the chemicals are forced from the article and delivered to the skin, instead of retaining them on the cloth.

Example 11

An article can be prepared having the same exterior layers as Examples 2-6. The inflatable bladder comprises first impermeable layer, which is a 1 mil thick PE Film, against the Avgol exterior side. The inflatable bladder comprises a second layer which is an Open Cell Foam having been modified as indicated in the table above. The modified foam layer has a Permeability of 0.43 $cm^3/cm^2/sec$. Add sodium bicarbonate (0.90 gm/article, or 63 gsm) between the foam and film layers along with a 2 ml rupturable reservoir containing 33.3% citric acid solution. Add surfactant in three lengthwise strips, 5.0 grams/article of surfactant composition 2, then seal. Seal the perimeter is in the same manner as Example 2, and cut the article to the same size as Example 2. Dry the article. Prior to activation, the article has a Pre-Inflation Thickness of 9.98 mm. To maximize inflation, inflate the bladder by first lathering the article with a small amount of water to coat the batting and foam layers with a lather, then rupture the rupturable reservoir to activate the article. Measured the properties of the article after lathering and activating the article. The article has an Inflated Thickness of 16.4 mm, and an Expansion Ratio of about 124%, and a High Pressure Thickness of 9.32 mm. The article has useful lather properties and expansion due to the combination of a first impermeable layer and second layer having low permeability in the inflatable bladder, and flattens easily for disposal after use.

Example 12

An article can be prepared having the same exterior layers as Examples 2-6. The inflatable bladder comprises first impermeable layer, which is a 1 mil thick PE Film, against the Avgol exterior side, and a diaper backsheet having a moisture vapor transmission rate. Gas Evolving materials (sodium bicarbonate, citric acid and water) are prepared and added in the same manner and amount as Example 2. Surfactant is added, 5.0 grams/article of surfactant composition 2, after sealing by a slot coater, applying onto the surface of the batting. Properties of the article are tested in the absence of the surfactant component, which is washed away and the article dried prior to testing and activation. Prior to activation, the article has a Pre-Inflation Thickness of 4.41 mm. The article has an Inflated Thickness of 18.34 mm, and an Expansion Ratio of about 420%, and a High Pressure Thickness of 14.37 mm. All areas of the bladder have a Permeability of 0 $cm^3/cm^2/sec$. The article remains inflated during showering, and over time deflates to facilitate disposal.

Example 13

An article can be prepared which inflates rapidly and which rate is not controlled by dissolution of any component by predissolving all gas evolving materials in the bladder interior. The article has the same interior and exterior layers as Example 2. Add to a rupturable reservoir 2.0 ml of 33.3% citric acid solution in water interior to the bladder. Add sodium bicarbonate to the bladder interior, 0.40 gm per article (28 gsm). Add 1.0 ml of water to the interior. Seal the final side of the inflatable bladder. The interior of the bladder thus contains, in separate locations, citric acid solution and sodium bicarbonate solution, which are stable (i.e., do not react) until activated by a user by rupturing the rupturable reservoir. Add Surfactant, 5.0 grams/article of surfactant composition 2, after sealing, by a slot coater, apply onto the surface of the batting. Properties of the article are tested in the absence of the surfactant component, which is rinsed away and the article dried prior to testing and activation. Prior to activation, the article has a Pre-Inflation Thickness of 4.17 mm. The article has an Inflated Thickness of 15.57 mm, an Expansion Ratio of about 370%, and a High Pressure Thickness of 12.22 mm. All areas of the bladder have a Permeability of 0 $cm^3/cm^2/sec$.

Example 14

An article can be prepared which is useful for cleansing the face. The article has the same interior and exterior layers as Example 2. Spray surfactant on the batting and dry prior to fabrication of the article, at rate of about 1 gram of wet surfactant composition 3 per article (over 300 gsm). Add a rupturable reservoir comprising 1 ml of 33.3% citric acid solution in water to the bladder interior. Add sodium bicarbonate, 0.075 gm per article, to the bladder interior. Seal the article in an elliptical perimeter measuring about 50 mm×75 mm along the ellipse axes, measuring to the inside edge of the seal. Cut the article leaving an unsealed trim area outside the seal. Accomplish the seal by an ultrasonic sealer (Branson Model 921). The article lathers easily and inflates rapidly, and is easy to use for face scrubbing and cleaning. During use, the exterior chemicals are easily exhausted so that after exhausting them, the article can be used to rub against the skin.

Example 15

A dish scrubbing article can be prepared. The article comprises an exterior layer which is a polypropylene scrim (19 gsm, available for example from Conwed Plastics, Minneapolis, Minn., USA), an interior layer which is a batting located next to the scrim, first and second layers of 2 mil thick PE film which are the inflatable bladder, and a layer of hydroentangled rayon/polyester blend having a basis weight of about 55 gsm. Add to a rupturable reservoir 2.0 ml of 33.3% citric acid solution in water and 0.90 gm sodium bicarbonate to the inflatable bladder. Coat commercial Dawn (D dishwashing liquid onto the scrim and batting side at a rate of 8.5 ml per article and dry and package the article in a flow wrap package with a fitment (i.e., a pop open resealable lid on the side of the package).

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A self-inflating article comprising:

a) an inflatable bladder comprising a substrate comprising a first layer and a second layer which forms a sack;

a) at least one rupturable reservoir associated with said inflatable bladder; and b) a cleansing composition;

wherein said web comprising said first layer and said second layer are low liquid permeable.

2. The article of claim 1, wherein said substrate is selected from the group consisting nonwovens, formed films, films, composite material, laminates, wovens and combinations thereof.

3. The article of claim 1, further comprising a gas evolving composition wherein said gas-evolving composition is associated with said inflatable bladder.

4. The article of claim 3, said gas evolving composition further comprises an alkaline and an acidic material.

5. The article of claim 4, said alkaline is selected from the group consisting of salts of carbonates and bicarbonates, alkaline peroxides, alkaline azides and mixtures thereof.

6. The article of claim 4, further comprising less than about 75 gsm of said alkaline material.

7. The article of claim 4, said acid material is selected from the group consisting of $C_2$ to $C_{20}$ organic mono- and poly-carboxylic acids, $C_2$ to $C_{20}$ organophosphorous acids, $C_2$ to $C_{20}$ organosulfur, toluene sulfonic acid, peroxides, lactones and mixtures thereof.

8. The article of claim 1, wherein said rupturable reservoir contains a reaction material.

9. The article of claim 8, said reaction material is selected from the group consisting of water, salts of carbonates and bicarbonates, alkaline peroxides, alkaline azides, $C_2$ to $C_{20}$ organic mono- and poly-carboxylic acids, $C_2$ to $C_{20}$ organophosphorous acids, $C_2$ to $C_{20}$ organosulfur, toluene sulfonic acid, peroxides, lactones and mixtures thereof.

10. The article of claim 9, wherein said reaction material is selected from the group consisting of water, citric acid, sodium bicarbonate and mixtures thereof.

11. The article of claim 8, wherein said rupturable reservoir delivers said reaction material within said inflatable bladder.

12. The article of claim 1, said cleansing composition is located on at least one surface of the first layer.

13. The article of claim 1, said cleansing composition is selected from the group consisting of anionic lathering surfactants, nonionic lathering surfactants, amphoteric lathering surfactants, and mixtures thereof.

14. The article of claim 1, further comprising a bonding site located at a center location of said article wherein said bonding site is selected from the group consisting of point bonding, bonding lines, bonding areas and combinations thereof.

15. The article of claim 1, wherein said cleansing composition is added at the point of use.

16. A kit for cleansing the skin and other keratinous surfaces, said kit comprising:

a) a container having a seal that is removed prior to first use of the article, said container having a cover wherein the cover protects the products not in use; and b) a self-inflating personal care article comprising, 1. an inflatable bladder comprising a substrate; comprising a first layer and a second layer which forms a sack;
2. at least one rupturable reservoir associated with said bladder; and
3. a cleansing composition;

wherein said substrate comprising said first layer and said second layer are low liquid permeable.

17. The kit of claim 16, said cleansing composition is located on at least one surface of said article.

* * * * *